US012258727B2

(12) United States Patent
Sugiyama

(10) Patent No.: US 12,258,727 B2
(45) Date of Patent: Mar. 25, 2025

(54) SHOVEL AND REMOTE OPERATION SUPPORT APPARATUS

(71) Applicant: SUMITOMO HEAVY INDUSTRIES, LTD., Tokyo (JP)

(72) Inventor: Yuta Sugiyama, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 278 days.

(21) Appl. No.: 17/811,984

(22) Filed: Jul. 12, 2022

(65) Prior Publication Data

US 2022/0341124 A1 Oct. 27, 2022

Related U.S. Application Data

(63) Continuation of application No. PCT/JP2021/000885, filed on Jan. 13, 2021.

(30) Foreign Application Priority Data

Jan. 14, 2020 (JP) ..... 2020-003806

(51) Int. Cl.
*E02F 3/43* (2006.01)
*E02F 3/42* (2006.01)

(52) U.S. Cl.
CPC ..... *E02F 3/439* (2013.01); *E02F 3/425* (2013.01); *E02F 3/437* (2013.01)

(58) Field of Classification Search
CPC . E02F 3/439; E02F 3/425; E02F 3/437; E02F 9/123; E02F 9/2033; E02F 9/2203; E02F 9/2285; E02F 9/2296; E02F 9/205; E02F 9/22; E02F 9/26
See application file for complete search history.

(56) References Cited

U.S. PATENT DOCUMENTS 2,995,261 A * 8/1961 Soyland ..... E02F 9/085 414/694
4,393,606 A * 7/1983 Warnecke ..... E02F 3/435 172/430
2009/0301075 A1 12/2009 Morinaga et al.
2010/0049410 A1* 2/2010 McKee ..... E02F 9/2012 701/50

(Continued)

FOREIGN PATENT DOCUMENTS

JP 2013-231464 11/2013
JP 2018-168666 11/2018

(Continued)

OTHER PUBLICATIONS

International Search Report for PCT/JP2021/000885 mailed on Apr. 6, 2021.

*Primary Examiner* — Adam R Mott
*Assistant Examiner* — Sagar Kc
(74) *Attorney, Agent, or Firm* — IPUSA, PLLC

(57) ABSTRACT

A shovel includes a plurality of driven elements, a plurality of actuators configured to drive the plurality of driven elements, and a hardware processor configured to, in response to detecting that two or more actuators of the plurality of actuators are synchronously moved, prohibit a motion of another actuator of the plurality of actuators that is different from the two or more actuators of the plurality of actuators.

15 Claims, 17 Drawing Sheets

(56) References Cited

U.S. PATENT DOCUMENTS

| | | | | |
|---|---|---|---|---|
| 2011/0257816 | A1* | 10/2011 | Song | E02F 9/2008 701/2 |
| 2011/0311342 | A1* | 12/2011 | Montgomery | E02F 9/264 414/685 |
| 2012/0089288 | A1* | 4/2012 | Kawashima | F02D 29/06 180/65.265 |
| 2017/0107692 | A1* | 4/2017 | Robertson | E02F 9/265 |
| 2017/0107697 | A1* | 4/2017 | Kawashima | E02F 9/2228 |
| 2018/0137446 | A1* | 5/2018 | Shike | G06Q 50/08 |
| 2018/0230671 | A1* | 8/2018 | Wu | E02F 3/437 |
| 2018/0282969 | A1 | 10/2018 | Hita et al. | |
| 2021/0025135 | A1 | 1/2021 | Sakuta | |

FOREIGN PATENT DOCUMENTS

| | | | |
|---|---|---|---|
| JP | 2018-172858 | | 11/2018 |
| JP | 2019015105 | A * | 1/2019 |
| WO | 2007/052538 | | 5/2007 |
| WO | 2019/189031 | | 10/2019 |

* cited by examiner

| ACTUATOR | | TRAVELING HYDRAULIC MOTOR | TURNING HYDRAULIC MOTOR | BOOM CYLINDER | ARM CYLINDER | BUCKET CYLINDER |
|---|---|---|---|---|---|---|
| DRIVEN ELEMENT | | LOWER TRAVELING BODY | UPPER TURNING BODY | BOOM | ARM | BUCKET |
| OPERATION CONTENT | EXCAVATION OPERATION<br>FINISHING OPERATION<br>COMPACTION OPERATION | × | × | ◎ | ◎ | ◎ |
| | BOOM RAISING AND TURNING MOVEMENT<br>BOOM LOWERING AND TURNING MOVEMENT | × | ◎ | ◎ | × | × |
| | EARTH UNLOADING OPERATION (DUMP OPERATION) | × | × | × | ◎ | ◎ |

◎: SYNCHRONOUS OPERATION ×: OPERATION PROHIBITED

FIG.13

FIG.18

| ACTUATOR | | TRAVELING HYDRAULIC MOTOR | TURNING HYDRAULIC MOTOR | BOOM CYLINDER | ARM CYLINDER | BUCKET CYLINDER |
|---|---|---|---|---|---|---|
| DRIVEN ELEMENT | | LOWER TRAVELING BODY | UPPER TURNING BODY | BOOM | ARM | BUCKET |
| WORK CONTENT | FINISHING WORK (FIRST AND SECOND WORK CONTENT CONDITIONS) | | | | | |
| | CONSTRUCTION WORK OF SLOPE (THIRD WORK CONTENT CONDITION) | × | × | ◎ | ◎ | ◎ |
| | CONSTRUCTION WORK OF GROOVE (FOURTH AND FIFTH WORK CONTENT CONDITIONS) | | | | | |

◎: SYNCHRONOUS OPERATION ×: OPERATION PROHIBITED

SHOVEL AND REMOTE OPERATION SUPPORT APPARATUS

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2021/000885, filed on Jan. 13, 2021, and designating the U.S., which claims priority to Japanese Patent Application No. 2020-003806 filed on Jan. 14, 2020. The entire contents of the foregoing applications are incorporated herein by reference.

BACKGROUND

Technical Field

The present disclosure relates to a shovel and the like.

Description of Related Art

According to a conventional technique, when a plurality of actuators are synchronously moved and another actuator is operated, the motion of the another actuator is prioritized.

SUMMARY

A shovel according to an embodiment of the present disclosure includes:

a plurality of driven elements;

a plurality of actuators configured to drive the plurality of driven elements; and a hardware processor configured to, in response to detecting that two or more actuators of the plurality of actuators are synchronously moved, prohibit a motion of another actuator of the plurality of actuators that is different from the two or more actuators of the plurality of actuators.

BRIEF DESCRIPTION OF THE DRAWINGS

FIG. 13 is a drawing for explaining actuator groups that move synchronously according to motion contents of a shovel, and actuators of which the motions are prohibited.

FIG. 18 is a drawing for explaining actuator groups that move synchronously during particular work, and actuators of which the motions are prohibited.

EMBODIMENT OF THE INVENTION

According to a conventional technique, when a plurality of actuators are synchronously moved and another actuator is operated, the motion of the another actuator is prioritized.

For example, the function of automatically synchronously moving the boom is disabled, when a turning operation is performed during machine control of performing excavation by automatically moving the boom upward and downward in synchronization with the operation of at least one of the arm and the bucket.

However, there is a problem in that the work efficiency of the shovel decreases if the motion of another actuator is prioritized when the work is performed by synchronously moving a plurality of actuators.

In view of the above-described problem, it is an object to provide a technique capable of alleviating a reduction in the work efficiency of the shovel when the work is performed by synchronously moving a plurality of actuators.

Hereinafter, an embodiment will be described with reference to drawings.

[Overview of Shovel]

First, an overview of a shovel 100 according to the present embodiment is explained with reference to FIG. 1 to FIG. 3.

Figure 1:
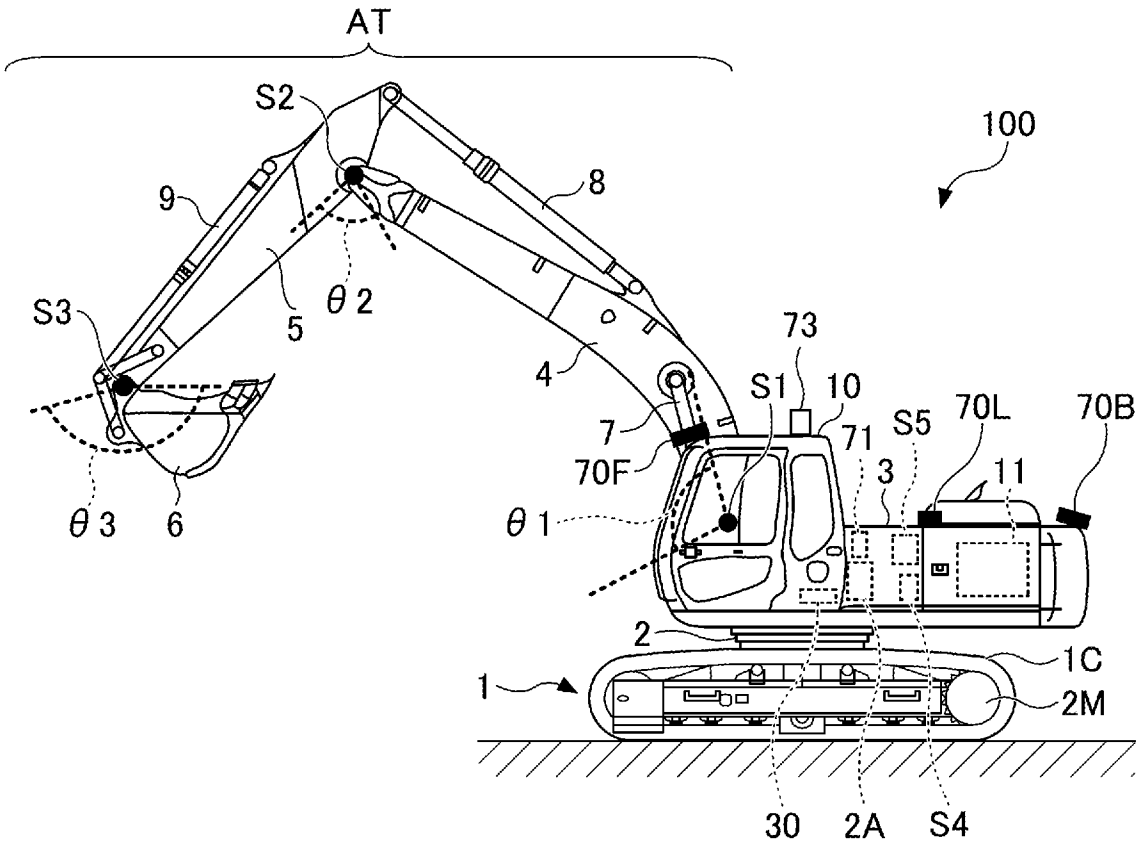
FIG. 1 is a side view illustrating an example of a shovel.

FIG. 1 is a side view illustrating an example of a shovel 100 according to the present embodiment. FIG. 2 is a plan view illustrating an example of the shovel 100 according to the present embodiment. FIG. 3 is a drawing illustrating an example of a shovel management system SYS including the shovel 100 according to the present embodiment.

Figure 2:
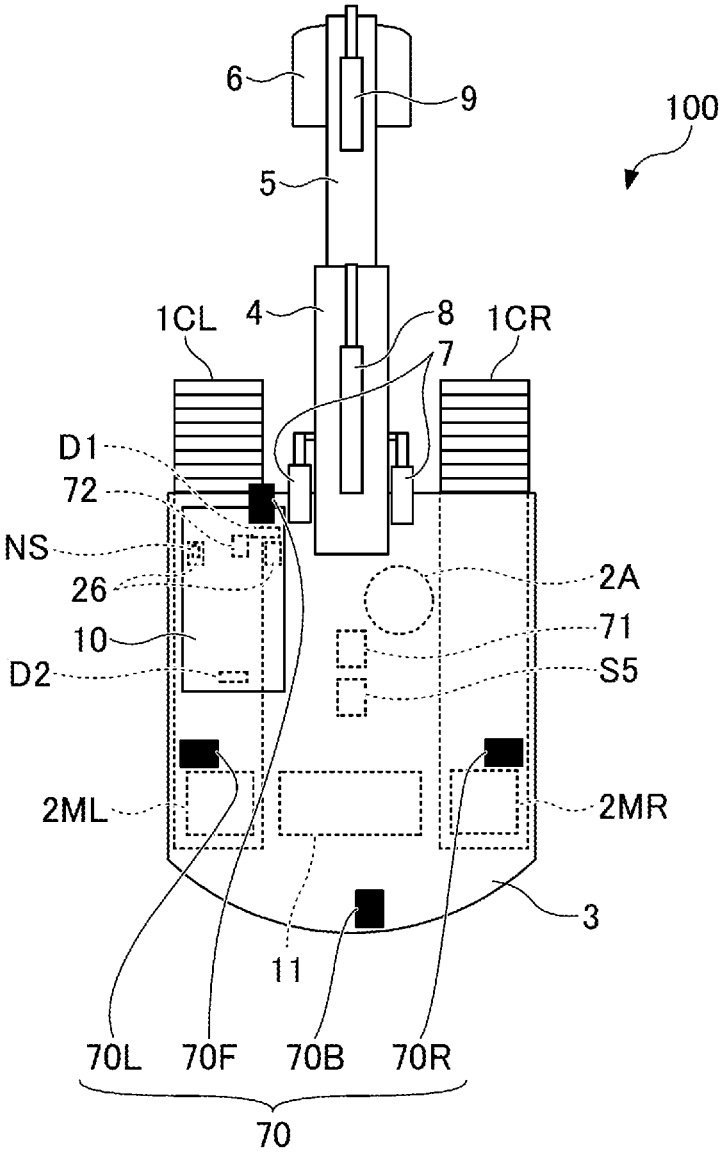
FIG. 2 is a plan view illustrating an example of the shovel.

As illustrated in FIG. 1 and FIG. 2, the shovel 100 according to the present embodiment includes a lower traveling body 1, an upper turning body 3 turnably mounted on the lower traveling body 1 with a turning mechanism 2, an attachment AT attached to the upper turning body 3, and a cab 10 provided on the upper turning body 3.

The lower traveling body 1 includes a pair of right and left crawlers 1C, i.e., a left side crawler 1CL and a right side crawler 1CR. When the left side crawler 1CL and the right side crawler 1CR are hydraulically driven by traveling hydraulic motors 1M, i.e., a left side traveling hydraulic motor 1ML and a right side traveling hydraulic motor 1MR, respectively, the lower traveling body 1 causes the shovel 100 to travel. Specifically, the traveling hydraulic motors 1ML, 1MR, serving as driving elements, drive the crawlers 1CL, 1CR, i.e., driven elements.

When a turning hydraulic motor 2A (an example of a turning motor) hydraulically drives the upper turning body 3, the upper turning body 3 turns with respect to the lower traveling body 1. The turning hydraulic motor 2A serving as a driving element drives the upper turning body 3 serving as a driven element.

The upper turning body 3 may be electrically driven by a motor (hereinafter referred to as a "turning motor"), instead of being driven by the turning hydraulic motor 2A. In this case, similar to the turning hydraulic motor 2A, the turning motor serving as a driving element drives the upper turning body 3 serving as a driven element.

The attachment AT includes a boom 4, an arm 5, and a bucket 6.

The boom 4 is pivotally attached to the front center of the upper turning body 3 to be able to vertically pivot. The arm 5 is pivotally attached to the end of the boom 4 to be able to pivot vertically. The bucket 6 is pivotally attached to the end of the arm 5 to be able to pivot vertically. The boom 4, the arm 5, and the bucket 6 are hydraulically driven by a boom cylinder 7, an arm cylinder 8, and a bucket cylinder 9, respectively, serving as hydraulic actuators.

It should be noted that the bucket 6 is an example of an end attachment. According to the work content and the like, instead of the bucket 6, other end attachments such as, for example, a slope finishing bucket, a dredging bucket, a breaker, and the like may be attached to the end of the arm 5.

The cab 10 is an operation room in which the operator rides, and is mounted on the front left of the upper turning body 3.

The shovel 100 operates driven elements such as a lower traveling body 1 (crawlers 1CL, 1CR), an upper turning body 3, a boom 4, an arm 5, a bucket 6, and the like according to operations of the operator who rides in the cab 10.

Furthermore, the shovel 100 may be configured to be remotely operated (remote operation) from the outside of the shovel, instead of or in addition to being configured to be operable by the operator who rides in the cab 10. In the case where the shovel 100 is remotely operated, the inside of the cab 10 may be unmanned. In the following explanation, it is assumed that operator's operations include at least one of an operation with an operation apparatus 26 by the operator of the cab 10 and a remote operation by the operator of an external apparatus.

The remote control includes, for example, a mode in which the shovel 100 is operated by an operation input for an actuator of the shovel 100 performed by a predetermined external apparatus. In this case, for example, the shovel 100 may transmit image information (captured image) output from an imaging apparatus included in a space recognition apparatus 70 explained later to an external apparatus, and the image information may be displayed on a display apparatus (hereinafter referred to as a "remote operation display apparatus") provided in the external apparatus. Various kinds of information images (information screens) displayed on a display apparatus D1 in the cab 10 of the shovel 100 may also be displayed on the remote operation display apparatus of the external apparatus. Thus, the operator of the external apparatus can remotely operate the shovel 100 while confirming display contents such as a captured image and an information screen showing the situation of the surroundings of the shovel 100 that are displayed on the remote operation display apparatus, for example. The shovel 100 may move the actuators to drive the driven elements such as the lower traveling body 1 (crawlers 1CL, 1CR), the upper turning body 3, the boom 4, the arm 5, and the bucket 6, according to a remote operation signal indicative of the contents of the remote operation received from an external apparatus by a communication apparatus T1 explained later.

Figure 3:
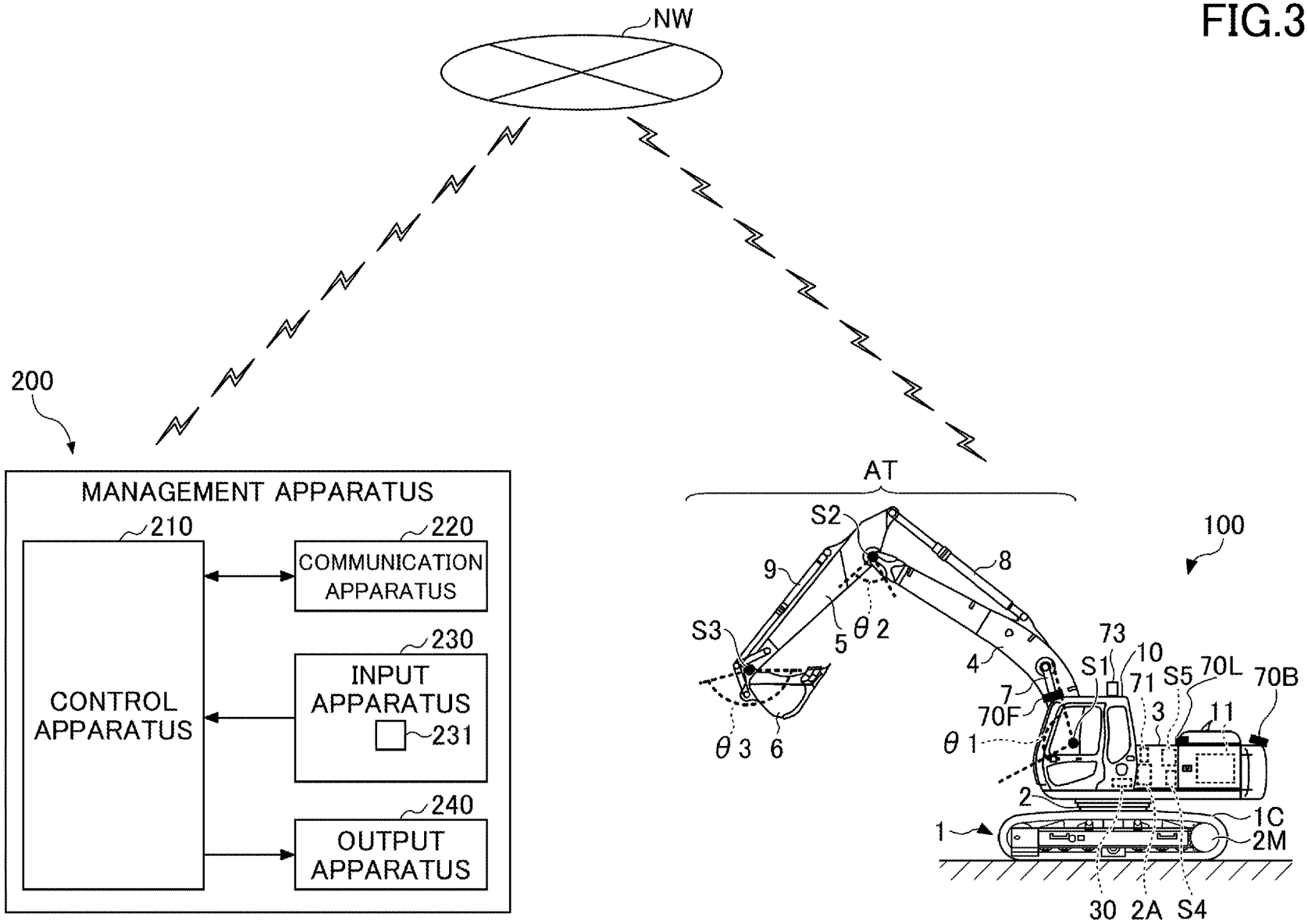
FIG. 3 is a drawing illustrating an example of a shovel management system.

For example, as illustrated in FIG. 3, the shovel 100 may be communicably connected to the management apparatus 200 as a component of the shovel management system SYS, and may be remotely operated through the management apparatus 200.

The shovel management system SYS may include one or a plurality of shovels 100. Similarly, the shovel management system SYS may include a plurality of management apparatuses 200. That is, the plurality of management apparatuses 200 may perform processing related to the shovel management system SYS in a distributed manner. For example, the plurality of management apparatuses 200 may mutually communicate with some of the plurality of shovels 100 to be managed, and execute processing on the some of the plurality of shovels 100.

The management apparatus 200 may be, for example, a cloud server or an on-premises server installed in a management center or the like outside the work site where the shovel 100 performs work. The management apparatus 200 may be, for example, an edge server provided in a work site where the shovel 100 performs work or at a location relatively close to the work site (for example, in a communication station building, a base station, or the like of a telecommunications carrier). The management apparatus 200 may be a stationary terminal apparatus provided in a management office or the like in the work site of the shovel 100, or may be a portable terminal apparatus (portable terminal). The stationary terminal apparatus may include, for example, a desktop computer terminal. The portable terminal apparatus may include, for example, a smartphone, a tablet terminal, a laptop computer terminal, and the like.

As illustrated in FIG. 3, the management apparatus 200 includes a control apparatus 210, a communication apparatus 220, an input apparatus 230, an output apparatus 240.

The control apparatus 210 performs various controls of the management apparatus 200. The function of the control apparatus 210 is achieved by any hardware or any combination of hardware and software. The control apparatus 210 is mainly composed of a computer including, for example, a CPU (central processing unit), a memory device such as RAM (random access memory), a nonvolatile auxiliary storage device such as ROM (read only memory), an interface device for input and output, and the like. The control apparatus 210 achieves various functions, for example, by causing the CPU to execute a program installed in the auxiliary storage device.

For example, the control apparatus 210 controls the remote operation of the shovel 100. The control apparatus 210 may receive an input signal relating to the remote control of the shovel 100 received by the remote operation apparatus and transmit a remote control signal indicative of the contents of the operation input, i.e., the contents of the remote control of the shovel 100, to the shovel 100 using the communication apparatus 220.

The communication apparatus 220 is connected to a communication network NW and communicates with the outside of the management apparatus 200 (for example, the shovel 100). The communication apparatus 220 may include a transmitter and a receiver configured to transmit an operation command related to the plurality of actuators to the shovel in response to an operation of a remote operation apparatus 231 (a remote controller) explained later.

The communication network NW includes, for example, a wide area network (WAN). The wide area network may include, for example, a mobile communication network having a base station as a terminal. The wide area network may include, for example, a satellite communication network using a communication satellite in the sky above the shovel 100. The wide area network may include, for example, the Internet. The communication network NW may include, for example, a local area network (LAN) provided in a facility where the management apparatus 200 is installed. The local area network may be a wireless network, a wired network, or a network including both. The communication network NW may include, for example, a short-range communication network based on a predetermined wireless communication system such as WiFi or Bluetooth (registered trademark).

The input apparatus 230 receives an input from a manager, a worker, or the like of the management apparatus 200 and outputs a signal indicative of the content of the input (for example, an operation input, a voice input, a gesture input, and the like). A signal indicative of the content of the input is received by the control apparatus 210.

The input apparatus 230 includes, for example, a remote operation apparatus 231. Thus, the worker (operator) of the management apparatus 200 can remotely control the shovel 100 by using the remote operation apparatus 231. The remote operation apparatus 231 may be, for example, a remote controller configured to remotely operate a plurality of actuators of the shovel that includes a plurality of driven elements and the plurality of actuators configured to drive the plurality of driven elements.

The output apparatus 240 outputs various kinds of information to the user of the management apparatus 200.

The output apparatus 240 includes, for example, a lighting device and a display apparatus for outputting various information to the user of the management apparatus 200 in a visual manner. The lighting device includes, for example, a warning lamp. The display apparatus includes, for example, a liquid crystal display and an organic EL (electroluminescence) display. The output apparatus 240 also includes a sound output device for outputting various information to the user of the management apparatus 200 in an auditory manner. The sound output device includes, for example, a buzzer or a speaker.

The display apparatus displays various information images related to the management apparatus 200. The display apparatus may include, for example, a remote operation display apparatus, and the remote operation display apparatus may display image information and the like of the surroundings of the shovel 100 (a surroundings image) uploaded from the shovel 100 under the control of the control apparatus 210. Thus, the user (operator) of the management apparatus 200 can perform the remote operation of the shovel 100 while confirming the image information of the surroundings of the shovel 100 displayed on the remote operation display apparatus.

The remote operation may include a mode in which the shovel 100 is operated, for example, by voice input or gesture input from the outside to the shovel 100 by a person (for example, a worker) around the shovel 100. More specifically, the shovel 100 recognizes voices spoken by a worker or the like in the surroundings, gestures performed by a worker or the like, through a voice input apparatus (for example, a microphone), a gesture input apparatus (for example, an imaging apparatus), and the like mounted on the shovel 100. Then, the shovel 100 may move actuators to drive a driven elements such as the lower traveling body 1 (the crawlers 1CL, 1CR), the upper turning body 3, the boom 4, the arm 5, the bucket 6, and the like according to the recognized contents of voice, gesture, and the like.

The shovel 100 may automatically move the actuators regardless of the contents of the operation by the operator. Thus, the shovel 100 achieves a function of automatically moving at least some of driven elements such as the lower traveling body 1 (the crawler 1CL, 1CR), the upper turning body 3, the boom 4, the arm 5, and the bucket 6 (what is termed as "automatic operation function" or "machine control function").

The automatic operation function may include a function for automatically moving a driven element (a hydraulic actuator) other than a driven element (a hydraulic actuator) that is being moved according to the operation by the operator with the operation apparatus 26 or according to a remote operation (what is termed as a "semi-automatic operation function"). In addition, the automatic operation function may include a function for automatically moving at least some of the plurality of driven elements (hydraulic actuators) on the assumption that the operator does not operate the operation apparatus 26 and no remote operate operation is performed (what is termed as a "full-automatic operation function"). In the shovel 100, when the full-automatic operation function is activated, the interior of the cab 10 may be in an unmanned state. The semi-automatic operation function, the full-automatic operation function, and the like may include a mode in which the motion contents of a driven element (a hydraulic actuator) that is to be operated with the automatic operation are automatically determined according to a predetermined rule. The semi-automatic driving function, the full-automatic driving function, and the like may include a mode in which the shovel 100 autonomously makes various decisions, and the motion contents of a driven element (a hydraulic actuator) that is to be operated autonomously are determined according to the decision result (what is termed as an "autonomous driving function").

[Configuration of Shovel]

Next, a detailed configuration of the shovel 100 according to the present embodiment is described with reference to FIGS. 4 and 5 in addition to FIGS. 1 to 3.

Figure 4:
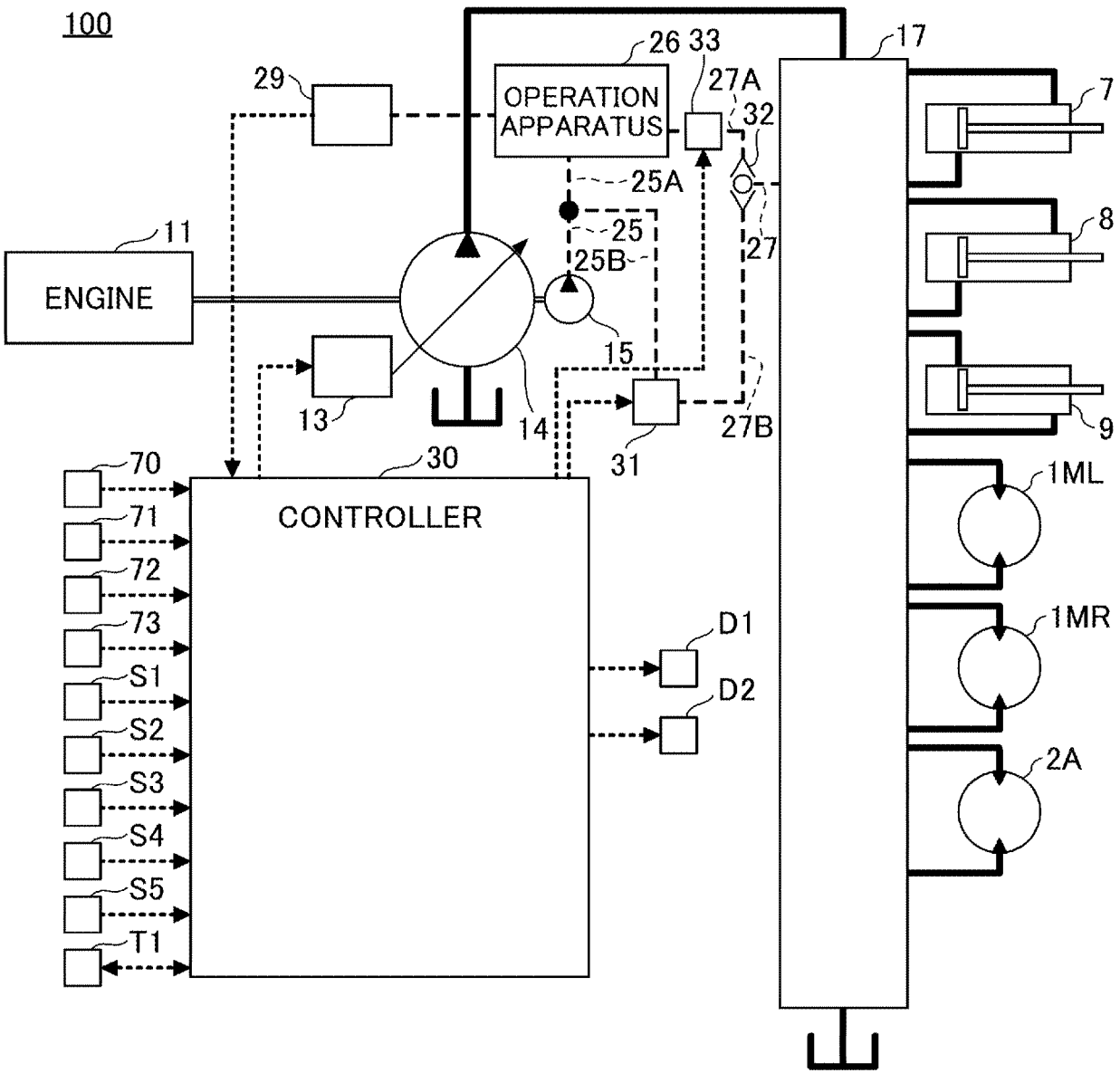
FIG. 4 is a block diagram illustrating an example of a configuration of the shovel.
Figure 5:
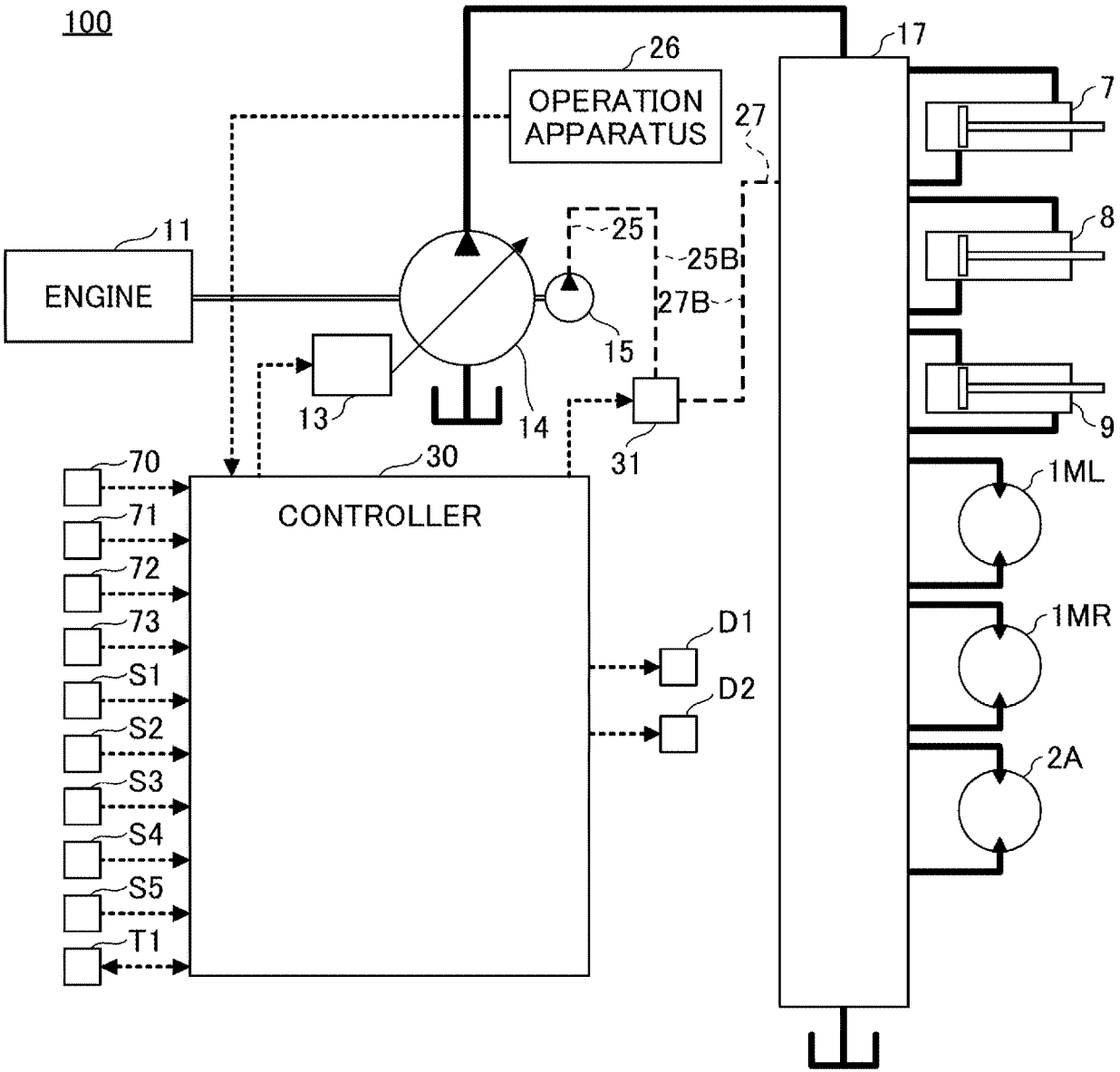
FIG. 5 is a block diagram illustrating another example of a configuration of a shovel.

FIGS. 4 and 5 are block diagrams illustrating an example and another example of configurations of the shovel 100 according to the present embodiment.

In FIGS. 4 and 5, a mechanical power system, a hydraulic oil line, a pilot line, and an electrical control system are denoted with a double line, a solid line, a dashed line, and a dotted line, respectively. The same applies to FIGS. 6 and 7.

<Hydraulic Driving System>

As illustrated in FIGS. 4 and 5, as described above, the hydraulic driving system of the shovel 100 according to the present embodiment includes the hydraulic actuators for hydraulically driving the plurality of driven elements (the lower traveling body 1, the upper turning body 3, the boom 4, the arm 5, and the bucket 6, and the like). The plurality of hydraulic actuators include the traveling hydraulic motors 1ML, 1MR, the turning hydraulic motor 2A, the boom cylinder 7, the arm cylinder 8, and the bucket cylinder 9 that drive the lower traveling body 1 (the crawlers 1CL, 1CR), the upper turning body 3, the boom 4, the arm 5, and the bucket 6, respectively. The hydraulic driving system of the shovel 100 according to the present embodiment includes an engine 11, a regulator 13, a main pump 14, and a control valve unit 17.

The engine 11 is a main power source in the hydraulic driving system. The engine 11 is, for example, a diesel engine using light oil as fuel. The engine 11 is mounted on the rear part of the upper turning body 3, for example. Specifically, under direct or indirect control by a controller 30 explained later, the engine 11 rotates constantly at a preset target rotational speed, and drives the main pump 14 and a pilot pump 15.

The regulator 13 controls the amount of discharge of the main pump 14 under the control of the controller 30. For example, the regulator 13 adjusts the angle (hereinafter referred to as a "tilt angle") of a swashplate of the main pump 14 according to a control command given by the controller 30.

The main pump 14 (an example of a hydraulic pump) supplies hydraulic oil to the control valve unit 17 through a high-pressure hydraulic line. The main pump 14 is mounted, for example, on the rear part of the upper turning body 3, similarly with the engine 11. The main pump 14 is driven by the engine 11 as described above. The main pump 14 is, for example, a variable displacement hydraulic pump, in which the regulator 13 controls the tilt angle of the swashplate to adjust the stroke length of a piston under the control performed by the controller 30 as described above, so that the discharge flowrate (discharge pressure) can be controlled.

The control valve unit 17 is a hydraulic control apparatus for controlling a hydraulic driving system according to an operation of the operator or an operation command corresponding to the automatic operation function of the shovel 100. The control valve unit 17 is mounted, for example, at the center of the upper turning body 3. The control valve unit 17 selectively supplies hydraulic oil supplied from the main pump 14 to the plurality of hydraulic actuators according to the contents of the operation or remote operation with the operation apparatus 26 or the contents of the operation command by the automatic operation function of the shovel 100. The control valve unit 17 includes a plurality of control valves (also referred to as direction switch valves) 17A (see FIGS. 6 and 7) for controlling the flow rate and flow direction of the hydraulic oil supplied from the main pump 14 to the plurality of hydraulic actuators.

<Operation System>

As illustrated in FIGS. 4 and 5, the operating system of the shovel 100 according to the present embodiment includes a pilot pump 15, an operation apparatus 26, a controller 30, and a hydraulic pressure control valve 31. As illustrated in FIG. 4, the operating system of the shovel 100 according to the present embodiment includes a shuttle valve 32 and a hydraulic pressure control valve 33, in the case where the operation apparatus 26 is of a hydraulic pilot type.

The pilot pump 15 supplies a pilot pressure to various hydraulic equipment through a pilot line 25. The pilot pump 15 is, for example, a fixed displacement hydraulic pump and is driven by the engine 11 as described above. The pilot pump 15 is mounted on the rear portion of the upper turning body 3 in the same manner as the engine 11, for example.

The operation apparatus 26 is provided near the operator's seat of the cab 10, and is used to allow the operator to operate various driven elements (the crawlers 1CL, 1CR, the upper turning body 3, the boom 4, the arm 5, the bucket 6, and the like) of the shovel 100. In other words, the operation apparatus 26 is used by the operator to operate the hydraulic actuator, i.e., the traveling hydraulic motors 1ML, 1MR, the turning hydraulic motor 2A, the boom cylinder 7, the arm cylinder 8, the bucket cylinder 9, and the like, for driving the respective driven elements.

For example, the operation apparatus 26 includes lever devices 26A (see FIG. 6 and FIG. 7) for operating left and right crawlers 1CL, 1CR (i.e., traveling hydraulic motors 1ML, 1MR), the upper turning body 3 (i.e., the turning hydraulic motor 2A), the boom 4 (i.e., the boom cylinder 7), the arm 5 (i.e., the arm cylinder 8), and the bucket 6 (i.e., the bucket cylinder 9)

For example, as illustrated in FIG. 4, the operation apparatus 26 is of a hydraulic pilot type. Specifically, the operation apparatus 26 uses hydraulic oil supplied from the pilot pump 15 through the pilot line 25 and a pilot line 25A branched from the pilot line 25, to output the pilot pressure according to the operation contents to a pilot line 27A on its secondary side. The pilot line 27A is connected to the inlet port of the shuttle valve 32, and connected to the control valve unit 17 via a pilot line 27 connected to the outlet port of the shuttle valve 32. Thus, the pilot pressure corresponding to the operation contents of the operation apparatus 26 for operating various driven elements (i.e., hydraulic actuators) can be input to the control valve unit 17 via the shuttle valve 32. Therefore, the control valve unit 17 can drive the respective hydraulic actuators according to the operation contents of the operation apparatus 26 by the operator or the like.

For example, as illustrated in FIG. 5, the operation apparatus 26 is an electric type. Specifically, the operation apparatus 26 outputs an electric signal (hereinafter referred to as an "operation signal") according to the operation contents, and the operation signal is received by the controller 30. Then, the controller 30 outputs a control command according to the contents of the operation signal, i.e., a control signal according to the operation contents that are input to the operation apparatus 26 to the hydraulic pressure control valve 31. Accordingly, the pilot pressure according to the operation contents that are input to the operation apparatus 26 is input from the hydraulic pressure control valve 31 to the control valve unit 17, and the control valve unit 17 can drive each of the hydraulic actuators according to the operation contents that are input to the operation apparatus 26 by the operator and the like.

The control valves 17A (direction switch valves) provided in the control valve unit 17 driving the hydraulic actuators may be of an electromagnetic solenoid type. In this case, an operation signal that is output from the operation apparatus 26 or a control command from the controller 30 may be directly input to the control valve unit 17, i.e., the control valves 17A of the electromagnetic solenoid type.

The hydraulic pressure control valve 31 is provided for each driven element (hydraulic actuator) to be operated by the operation apparatus 26. Specifically, the hydraulic pressure control valve 31 is provided for each of, for example, the crawler 1CL (the traveling hydraulic motor 1ML), the crawler 1CR (the traveling hydraulic motor 1MR), the upper turning body 3 (the turning hydraulic motor 2A), the boom 4 (the boom cylinder 7), the arm 5 (the arm cylinder 8), and the bucket 6 (the bucket cylinder 9). For example, the hydraulic pressure control valve 31 is provided in a pilot line 25B between the pilot pump 15 and the control valve unit 17. For example, the hydraulic pressure control valve 31 may be configured to be able to change the size of area of flow (i.e., the size of a cross-sectional area in which hydraulic oil can flow). Accordingly, the hydraulic pressure control valve 31 can output a predetermined pilot pressure to pilot line 27B on the secondary side by using hydraulic oil of the pilot pump 15 supplied through the pilot line 25B. Therefore, as illustrated in FIG. 4, the hydraulic pressure control valve 31 can indirectly apply a predetermined pilot pressure to the control valve unit 17 according to a control signal from the controller 30 through the shuttle valve 32 between the pilot line 27B and the pilot line 27. As illustrated in FIG. 5, in contrast to the case of FIG. 4, the pilot line 27A and the shuttle valve 32 are omitted, and the hydraulic pressure control valve 31 can directly apply a predetermined pilot pressure corresponding to a control signal from the controller 30 to the control valve unit 17 through the pilot line 27B and the pilot line 27. Accordingly, the controller 30 can supply a pilot pressure according to the operation contents of the operation apparatus 26 of the electric type from the hydraulic pressure control valve 31 to the control valve unit 17, so that the motion of the shovel 100 based on the operation of the operator can be achieved.

The controller 30 may control, for example, the hydraulic pressure control valve 31 to achieve remote operation of the shovel 100. Specifically, the controller 30 outputs, to the hydraulic pressure control valve 31, a control signal corresponding to the contents of the remote operation specified by the remote operation signal received from the external apparatus. Thereby, the controller 30 supplies the pilot pressure corresponding to the contents of the remote operation from the hydraulic pressure control valve 31 to the control valve unit 17, so that the motion of the shovel 100 based on the remote operation by the operator can be achieved.

The controller 30 may control, for example, the hydraulic pressure control valve 31 to achieve an automatic operation function. Specifically, the controller 30 outputs a control signal corresponding to an operation command related to the automatic operation function to the hydraulic pressure control valve 31 regardless of the presence or absence of an operation or remote operation of the operation apparatus 26. Thus, the controller 30 the hydraulic pressure control valve 31 to supply the pilot pressure corresponding to the operation command relating to the automatic operation function to the control valve unit 17, thereby achieving the motion of the shovel 100 based on the automatic operation function.

The hydraulic pressure control valve 31 includes, for example, hydraulic pressure control valves 31L, 31R, as explained later.

As illustrated in FIG. 4, the shuttle valve 32 includes two inlet ports and one output port, and is configured to output, from the output port, a hydraulic oil having a higher pump pressure from among the pump pressures applied to the two inlet ports. The shuttle valve 32 is provided for each driven element (hydraulic actuator) to be operated by the operation apparatus 26. Specifically, the shuttle valve 32 is provided for each of, for example, the crawler 1CL (the traveling hydraulic motor 1ML), the crawler 1CR (the traveling hydraulic motor 1MR), the upper turning body 3 (the turning hydraulic motor 2A), the boom 4 (the boom cylinder 7), the arm 5 (the arm cylinder 8), and the bucket 6 (the bucket cylinder 9). One of the two inlet ports of the shuttle valve 32 is connected to the pilot line 27A on the secondary side of the operation apparatus 26 (specifically, the lever devices 26A explained above included in the operation apparatus 26), and the other of the two inlet ports of the shuttle valve 32 is connected to the pilot line 27B on the secondary side of the hydraulic pressure control valve 31. The output port of the shuttle valve 32 is connected to the pilot port of the corresponding control valve 17A in the control valve unit 17 through the pilot line 27. The corresponding control valve 17A is a control valve 17A for driving a hydraulic actuator to be operated by the above-described lever device 26A connected to one of the inlet ports of the shuttle valve 32. Therefore, each of the shuttle valves 32 can apply one of the pilot pressure of the pilot line 27A on the secondary side of the operation apparatus 26 (the lever device 26A) and the pilot pressure of the pilot line 27B on the secondary side of the hydraulic pressure control valve 31, whichever is higher, to the pilot port of the corresponding control valve 17A. In other words, the controller 30 outputs, from the hydraulic pressure control valve 31, a pilot pressure higher than the pilot pressure of the pilot line 27A on the secondary side of the operation apparatus 26 to control the corresponding control valve 17A without relying on the operation of the operation apparatus 26 by the operator. Therefore, the controller 30 can achieve the automatic operation function and the remote operation function of the shovel 100 by controlling the motion of the driven elements (the crawlers 1CL, 1CR, the upper turning body 3, the boom 4, the arm 5, and the bucket 6) without relying on the operation state of the operation apparatus 26 by the operator.

The shuttle valve 32 includes, for example, shuttle valves 32L, 32R, as explained later.

As illustrated in FIG. 4, the hydraulic pressure control valve 33 is provided in the pilot line 27A connecting the operation apparatus 26 and the shuttle valve 32. The hydraulic pressure control valve 33 is configured to be able to change the size of area of flow. The hydraulic pressure control valve 33 operates according to a control signal input from the controller 30. Thus, the controller 30 can forcibly reduce the pilot pressure output from the operation apparatus 26 when the operation apparatus 26 is operated by the operator. Therefore, the controller 30 can forcibly reduce or stop the motion of the hydraulic actuator corresponding to the operation of the operation apparatus 26 even when the operation apparatus 26 is operated. Furthermore, for example, even in the case where the operation apparatus 26 is operated, the controller 30 can reduce the pilot pressure output from the operation apparatus 26 so that the pilot pressure becomes lower than the pilot pressure output from the hydraulic pressure control valve 31. Therefore, for example, by controlling the hydraulic pressure control valve 31 and the hydraulic pressure control valve 33, the controller 30 can reliably apply a desired pilot pressure to the pilot port of the control valve 17A in the control valve unit 17, regardless of the operation contents of the operation apparatus 26. Therefore, for example, the controller 30 can appropriately achieve the automatic operation function and the remote operation function of the shovel 100 by controlling the hydraulic pressure control valve 33 in addition to the hydraulic pressure control valve 31.

For example, the hydraulic pressure control valve 33 includes hydraulic pressure control valves 33L, 33R, as explained later.

The hydraulic pressure control valve 33 may be omitted. For example, the hydraulic pressure control valve 33 of FIG. 4 may be provided on the pilot line 27B of FIG. 5. Therefore, the controller 30 can forcibly reduce the pilot pressure output from the hydraulic pressure control valve 31 in the case where the operator operates the operation apparatus 26. Therefore, the controller 30 can forcibly reduce or stop the motion of the hydraulic actuator corresponding to the operation of the operation apparatus 26 even in the case where the pilot pressure corresponding to the operation contents of the operation apparatus 26 is outputted from the hydraulic pressure control valve 31.

<Control System>

As illustrated in FIGS. 4 and 5, the control system of the shovel 100 according to the present embodiment includes the controller 30, the space recognition apparatus 70, an orientation detection apparatus 71, an input apparatus 72, and a positioning apparatus 73. The control system of the shovel 100 according to the present embodiment includes a display apparatus D1, a sound output device D2, a boom angle sensor S1, an arm angle sensor S2, a bucket angle sensor S3, a body inclination sensor S4, a turning state sensor S5, and a communication apparatus T1. As illustrated in FIG. 4, the control system of the shovel 100 according to the present embodiment includes an operation pressure sensor 29 in the case where the operation apparatus 26 is a hydraulic pilot type.

For example, the controller 30 is provided in the cab 10 to perform various controls of the shovel 100. The functions of the controller 30 may be achieved by any given hardware, a combination of hardware and software, and the like. For example, the controller 30 is mainly constituted by a microcomputer including a CPU, a memory device such as a RAM, a nonvolatile auxiliary storage device such as a ROM, an interface device for input and output from and to the outside, and the like. Furthermore, for example, the controller 30 may include a high-speed computation such as a GPU (Graphical Processing Unit), an ASIC (Application Specific Integrated Circuit), an FPGA (field-programmable gate array), and the like that operates in synchronization with the CPU. The controller 30 achieves various functions, for example, by causing the CPU to execute a program installed in the auxiliary storage device.

For example, as described above, the controller 30 controls the remote operation function of the shovel 100 with respect to the hydraulic pressure control valve 31 and the like as the control target.

Furthermore, for example, the controller 30 recognizes the situation around the shovel 100 based on the output of the space recognition apparatus 70. The situation around the shovel 100 includes the locations and shapes of objects around the shovel 100. The objects around the shovel 100 may include, for example, ground, earth, suspended loads, utility poles, fences, road cones, buildings such as temporary offices, construction machinery, service vehicles, and the like.

Furthermore, for example, the controller 30 calculates (generates) a target of a trajectory of a predetermined work portion of the attachment of the shovel 100 (hereinafter referred to as a "target trajectory") achieved by the automatic operation function. The work portion is, for example, the claw tip of the bucket 6, the back surface of the bucket 6, or the like.

For example, the controller 30 generates an operation command related to the automatic operation function. Specifically, based on the outputs of the sensors S1 to S5 and the space recognition apparatus 70, the controller 30 generates an operation command for moving the work portion of the attachment along the target trajectory while confirming the position of the work portion of the attachment, and outputs the operation command to the controller 30.

For example, the controller 30 controls the hydraulic pressure control valve 31 based on the operation command related to the automatic operation function. Thus, the controller 30 can achieve the automatic operation function by automatically controlling the motion of at least one of the attachment, the lower traveling body 1, and the upper turning body 3 so that the work portion of the attachment moves along the target trajectory.

Some of the functions of the controller 30 may be implemented by other controllers (control apparatuses). That is, the functions of the controller 30 may be distributed among a plurality of controllers. For example, the function of recognizing the situation around the shovel 100, the function of generating the target trajectory of the work portion of the attachment, the function of generating the operation commands relating to the automatic operation function, and the like may be implemented by a dedicated controller (control apparatus) different from the controller 30.

The space recognition apparatus 70 recognizes an object existing in a three-dimensional space around the shovel 100, and acquires information for measuring (calculating) a positional relationship such as a distance to the recognized object from the space recognition apparatus 70 or the shovel 100. Furthermore, the space recognition apparatus 70 may perform not only the recognition of objects around the shovel 100 but also measuring of the positional relationship between the recognized objects and the space recognition apparatus 70 or the shovel 100 based on the acquired information. The space recognition apparatus 70 may include, for example, an ultrasonic sensor, a millimeter wave radar, a monocular camera, a stereo camera, a LIDAR (Light Detecting and Ranging) device, a distance image sensor, an infrared sensor, and the like. The space recognition apparatus 70 includes a front recognition sensor 70F, a rear recognition sensor 70B, a left side recognition sensor 70L, and a right side recognition sensor 70R.

For example, the front recognition sensor 70F is attached to the front end of the upper surface of the cab 10, and acquires information about an object in the space in front of the shovel 100 (the upper turning body 3).

For example, the rear recognition sensor 70B is attached to the rear end of the upper surface of the upper turning body 3 (a house portion), and acquires information about an object in the space behind the shovel 100 (the upper turning body 3).

For example, the left side recognition sensor 70L is attached to the left end of the upper surface of the upper turning body 3 (the house portion), and acquires information about an object in the space on the left side of the shovel 100 (the upper turning body 3).

For example, the right side recognition sensor 70R is attached to the right end of the upper surface of the upper turning body 3 (the house portion), and acquires information about an object in the space on the right side of the shovel 100 (the upper turning body 3).

An upper recognition sensor for acquiring information about an object existing in a space above the shovel 100 (the upper turning body 3) may also be provided.

The orientation detection apparatus 71 detects information (for example, the turning angle of the upper turning body 3 with respect to the lower traveling body 1) about the relative relationship between the orientation of the upper turning body 3 and the orientation of the lower traveling body 1.

For example, the orientation detection apparatus 71 may include a combination of a geomagnetic sensor attached to the lower traveling body 1 and a geomagnetic sensor attached to the upper turning body 3. The orientation detection apparatus 71 may also include a combination of a GNSS (Global Navigation Satellite System) receiver attached to the lower traveling body 1 and a GNSS receiver attached to the upper turning body 3. Furthermore, the orientation detection apparatus 71 may include a rotary encoder, a rotor reposition sensor, or the like capable of detecting the turning angle of the upper turning body 3 relative to the lower traveling body 1, that is, the turning state sensor S5 described above, and may be attached to, for example, a center joint provided in association with the turning mechanism 2 for achieving relative rotation between the lower traveling body 1 and the upper turning body 3. The orientation detection apparatus 71 may include an imaging apparatus attached to the upper turning body 3. In this case, the orientation detection apparatus 71 detects an image of the lower traveling body 1 included in an input image by applying conventional image processing to an image (input image) captured by the imaging apparatus attached to the upper rotating body 3. The orientation detection apparatus 71 may identify the longitudinal direction of the lower traveling body 1 and acquire an angle formed between the front-rear axial direction of the upper turning body 3 and the longitudinal direction of the lower traveling body 1. In this case, the front-rear axial direction of the upper turning body 3 is determined from the mounting position of the camera. In particular, since the crawler 1C protrudes from the upper turning body 3, the orientation detection apparatus 71 can identify the longitudinal direction of the lower traveling body 1 by detecting the image of the crawler 1C.

In the case where the upper turning body 3 is configured to be turned by a turning motor instead of the turning hydraulic motor 2A, the orientation detection apparatus 71 may be a resolver.

The input apparatus 72 is provided in an area that can be reached by the operator who sits on the seat in the cab 10, and receives various inputs from the operator and outputs signals according to the inputs to the controller 30. For example, the input apparatus 72 includes an operation input apparatus for receiving an operation input from the operator. The operation input apparatus may include, for example, a touch panel implemented in the display of the display apparatus D1. The operation input apparatus may include, for example, a touch pad, a button switch, a lever, a toggle, and the like, which are disposed around the display apparatus D1. The operation input apparatus may include, for example, a knob switch provided at the tip of the operation apparatus 26 (lever device 26A). For example, the input apparatus 72 may include a voice input apparatus or a gesture input apparatus for receiving voice input or gesture input from the operator. The voice input apparatus includes, for example, a microphone. The gesture input apparatus includes, for example, an imaging apparatus for capturing an image of the operator in the cab 10. The signal corresponding to the input content to the input apparatus 72 is received by the controller 30.

The positioning apparatus 73 measures the position and orientation of the upper turning body 3. The positioning apparatus 73 is, for example, a GNSS compass, which detects the position and orientation of the upper turning body 3, and a detection signal corresponding to the position and orientation of the upper turning body 3 is received by the controller 30. The function of detecting the orientation of the upper turning body 3 among the functions of the positioning apparatus 73 may be replaced by an azimuth sensor attached to the upper turning body 3.

The display apparatus D1 is provided at a position in the cab 10 that is easily visible from the seated operator, and displays various information images under the control of the controller 30. The display apparatus D1 is, for example, a liquid crystal display or an organic EL display. Thus, the display apparatus D1 can notify the operator of the visual information. The display apparatus D1 displays, for example, an image (hereinafter referred to as a "surroundings image") representing the situation around the shovel 100 based on the output (image information) of the imaging apparatus included in the space recognition apparatus 70. The surroundings image may be the image information itself of the surroundings of the shovel 100 captured by the imaging apparatus, or may be a processed image generated by applying conventional image processing (for example, viewpoint conversion processing) on the image information.

For example, the sound output device D2 is provided in the cab 10, and outputs a predetermined sound under the control of the controller 30. The sound output device D2 is, for example, a speaker or a buzzer. Thus, the sound output device D2 can notify the operator of auditory information.

The boom angle sensor S1 is attached to the boom 4 and detects the angle of the boom 4, for example, an elevation angle (hereinafter referred to as a "boom angle") 91 of the boom 4 with respect to the upper turning body 3. The boom angle sensor S1 may include, for example, a rotary encoder, an acceleration sensor, a six-axis sensor, an inertial measurement unit (IMU), and the like. The boom angle sensor S1 may include a potentiometer using a variable resistor, a cylinder sensor for detecting the stroke amount of the hydraulic cylinder (the boom cylinder 7) corresponding to the boom angle θ1, and the like. The same applies to the arm angle sensor S2 and the bucket angle sensor S3. The detection signal corresponding to the boom angle θ1 by the boom angle sensor S1 is received by the controller 30.

The arm angle sensor S2 is attached to the arm 5 and detects the angle of the arm 5, for example, a rotation angle (hereinafter referred to as an "arm angle") θ2 of the arm 5 with respect to the boom 4. The detection signal corresponding to the arm angle θ2 by the arm angle sensor S2 is received by the controller 30.

The bucket angle sensor S3 is attached to the bucket 6 and detects the angle of the bucket 6, for example, a rotation angle (hereinafter referred to as a "bucket angle") 93 of the bucket 6 with respect to the arm 5. The detection signal corresponding to the bucket angle 93 by the bucket angle sensor S3 is received by the controller 30.

The body inclination sensor S4 detects, for example, an inclination state of the machine body (the upper turning body 3 or the lower traveling body 1) with respect to the horizontal plane. For example, the body inclination sensor S4 is attached to the upper turning body 3, and detects an inclination angle (hereinafter referred to as a "longitudinal inclination angle" and a "lateral inclination angle") about two axes in the longitudinal direction and the lateral direction of the upper turning body 3. The body inclination sensor S4 may include, for example, a rotary encoder, an acceleration sensor, a six-axis sensor, an IMU, and the like. The detection signal corresponding to the inclination angle (the longitudinal inclination angle and the lateral inclination angle) by the body inclination sensor S4 is received by the controller 30.

The turning state sensor S5 is attached to the upper turning body 3 and outputs detection information about the turning state of the upper turning body 3. The turning state sensor S5 detects, for example, a turning angular velocity and a turning angle of the upper turning body 3. The turning state sensor S5 may include, for example, a gyro sensor, a resolver, a rotary encoder, an acceleration sensor, a six-axis sensor, an IMU, and the like.

When the body inclination sensor S4 includes a gyro sensor, a 6-axis sensor, an IMU, or the like capable of detecting the angular velocity about three axes, the turning state (for example, turning angular velocity) of the upper turning body 3 may be detected based on the detection signal of the body inclination sensor S4. In this case, the turning state sensor S5 may be omitted.

The communication apparatus T1 is connected to a predetermined communication network and communicates with an external apparatus. The predetermined communication network may include, for example, a mobile communication network having a base station as a terminal. The predetermined communication network may include, for example, a satellite communication network using a communication satellite. The predetermined communication network may include, for example, the Internet. The predetermined communication network may include, for example, a short-range communication network based on a short-range communication system such as WiFi or Bluetooth (registered trademark).

The operation pressure sensor 29 detects the operation state of the operation apparatus 26 in the form of pilot pressure (hereinafter referred to as an "operation pressure"). Specifically, the operation pressure sensor 29 detects the pilot pressure on the secondary side of the operation apparatus 26. A detection signal corresponding to the operation pressure detected by the operation pressure sensor 29 is received by the controller 30. Thus, the controller 30 can confirm the operation state of the operation apparatus 26.

[Details of Configuration of Operation System]

Next, the configuration of the operation system of the shovel 100 is described in detail with reference to FIGS. 6 and 7.

<Example of Configuration of Operation System>

Figure 6:
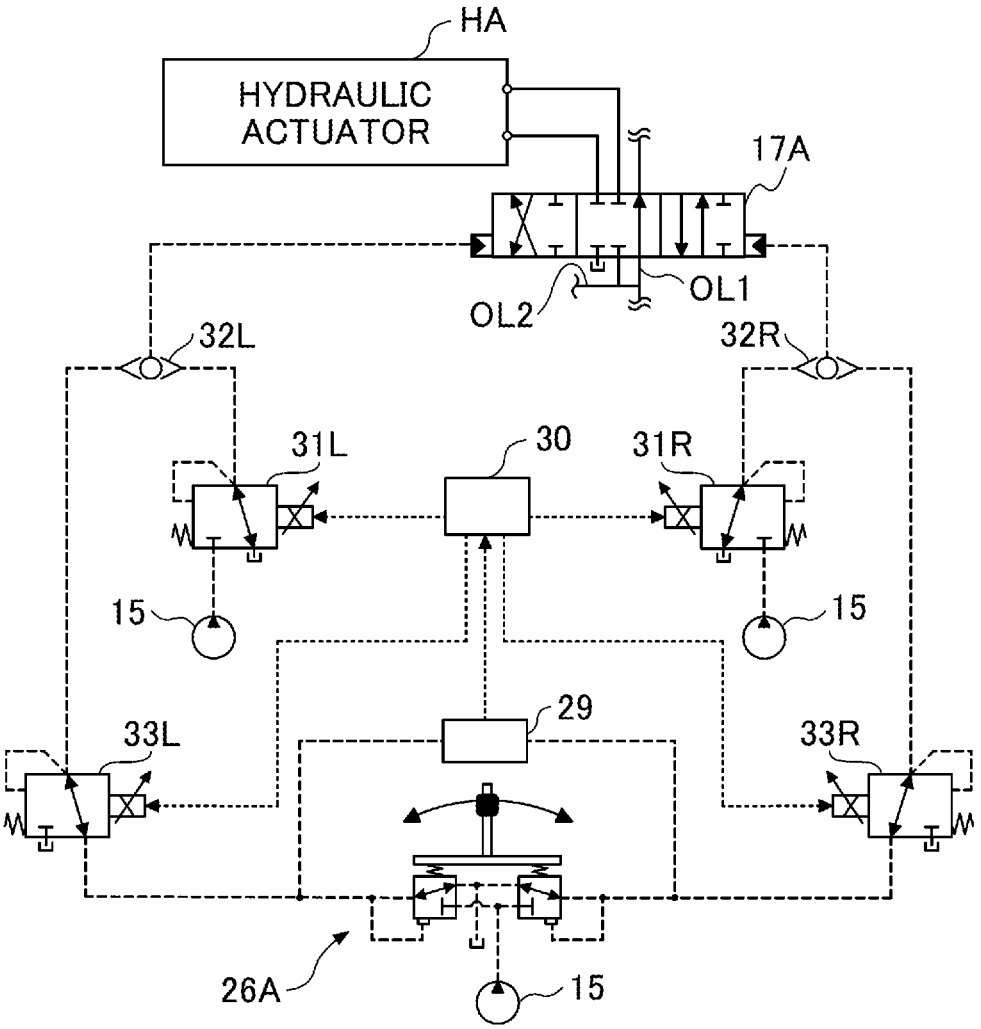
FIG. 6 is a drawing illustrating an example of configuration of an operation system of a shovel.

FIG. 6 is a drawing illustrating an example of configuration of an operation system of the shovel 100. Specifically, FIG. 6 is a drawing corresponding to the shovel 100 of FIG. 4 and illustrating a pilot circuit that supplies hydraulic oil to the hydraulic actuator HA and applies a predetermined pilot pressure to the control valve 17A for discharging hydraulic oil from the hydraulic actuator HA.

As described above, the hydraulic actuator HA (an example of an actuator) corresponds to any one of the traveling hydraulic motors 1ML and 1MR, the turning hydraulic motor 2A, the boom cylinder 7, the arm cylinder 8, the bucket cylinder 9, and the like.

The control valve 17A (an example of a spool valve) is a spool valve that supplies hydraulic oil supplied from the main pump 14 through the oil passage OL1 or OL2 to the hydraulic actuator HA and discharges hydraulic oil discharged from the hydraulic actuator HA to the hydraulic oil tank.

The lever device 26A is configured so that the operator can tilt the lever device 26A in two opposing directions (for example, in the longitudinal or lateral direction). Thus, the operator can operate the hydraulic actuator HA (i.e., a driven element driven by the hydraulic actuator HA) in one of the two opposing directions. For example, the operator can operate the boom 4 in the upward direction and the downward direction with the lever device 26A corresponding to the boom 4 (the boom cylinder 7). The lever device 26A outputs pilot pressure corresponding to the operation contents in the two opposing directions to the pilot line on the secondary side corresponding to the operation directions.

The operation pressure sensor 29 detects, in the form of pilot pressure (operation pressure), the operation contents of the operator in the two opposing directions with the lever device 26A, and the detection signal corresponding to the detected pressure is received by the controller 30. Thus, the controller 30 can confirm the operation contents of the lever device 26A.

The two inlet ports of the shuttle valve 32L are connected to the pilot line on the secondary side corresponding to the tilting operation of the lever device 26A in the first direction and the pilot line on the secondary side of the hydraulic pressure control valve 31L. The outlet port of the shuttle valve 32L is connected to the pilot port on the left side of the control valve 17A.

The two inlet ports of the shuttle valve 32R are connected to the pilot line on the secondary side corresponding to the tilting operation of the lever device 26A in the second direction and the pilot line on the secondary side of the hydraulic pressure control valve 31R. The outlet port of the shuttle valve 32R is connected to the pilot port on the right side of the control valve 17A.

The hydraulic pressure control valve 31L operates according to a control signal (a control current) input from the controller 30. Specifically, the hydraulic pressure control valve 31L outputs the pilot pressure according to the control current input from the controller 30 to the other of the inlet ports of the shuttle valve 32L by using hydraulic oil discharged from the pilot pump 15. Thus, the hydraulic pressure control valve 31L can adjust the pilot pressure applied to the pilot port on the left side of the control valve 17A via the shuttle valve 32L.

The hydraulic pressure control valve 31R operates according to a control signal (a control current) input from the controller 30. Specifically, the hydraulic pressure control valve 31R outputs the pilot pressure according to the control current input from the controller 30 to the other of the inlet ports of the shuttle valve 32R by using hydraulic oil discharged from the pilot pump 15. Thus, the hydraulic pressure control valve 31R can adjust the pilot pressure applied to the pilot port on the right side of the control valve 17A via the shuttle valve 32R.

Thus, the hydraulic pressure control valves 31L, 31R can adjust the pilot pressure output to the secondary side so that the control valve 17A can be stopped at any valve position regardless of the operation state of the lever device 26A.

The hydraulic pressure control valve 33L operates according to a control signal (a control current) input from the controller 30. Specifically, when the control current from the controller 30 is not input, the hydraulic pressure control valve 33L outputs the pilot pressure corresponding to the tilting operation of the lever device 26A in the first direction to the secondary side without change. Conversely, when the control current from the controller 30 is input, the hydraulic pressure control valve 33L reduces the pilot pressure of the pilot line on the secondary side corresponding to the tilting operation of the lever device 26A in the first direction to a degree corresponding to the control current, and outputs the reduced pilot pressure to one of the inlet ports of the shuttle valve 32L. Thus, the hydraulic pressure control valve 33L can forcibly reduce or stop the motion of the hydraulic actuator HA (i.e., a driven element driven by the hydraulic actuator HA) in the first direction as needed even when the lever device 26A is tilted in the first direction. Even when the lever device 26A is tilted in the first direction, the hydraulic pressure control valve 33L can reduce the pilot pressure applied to one of the inlet ports of the shuttle valve 32L to a pilot pressure lower than the pilot pressure applied to the other of the inlet ports of the shuttle valve 32L from the hydraulic pressure control valve 31L. Therefore, the controller 30 can reliably apply the desired pilot pressure to the pilot port on the left side of the control valve 17A by controlling the hydraulic pressure control valve 31L and the hydraulic pressure control valve 33L.

The hydraulic pressure control valve 33R operates according to a control signal (a control current) input from the controller 30. Specifically, when the control current from the controller 30 is not inputted, the hydraulic pressure control valve 33R outputs the pilot pressure corresponding to the tilting operation of the lever device 26A in the second direction to the secondary side without change. Conversely, when the control current from the controller 30 is input, the hydraulic pressure control valve 33R reduces the pilot pressure of the pilot line on the secondary side corresponding to the tilt operation of the lever device 26A in the second direction to a degree corresponding to the control current, and outputs the reduced pilot pressure to one of the inlet ports of the shuttle valve 32R. Thus, the hydraulic pressure control valve 33R can forcibly reduce or stop the motion of the hydraulic actuator HA (i.e., a driven element driven by the hydraulic actuator HA) in the second direction as needed even when the lever device 26A is tilted in the second direction. Even when the lever device 26A is tilted in the second direction, the hydraulic pressure control valve 33R can reduce the pilot pressure acting on one inlet port of the shuttle valve 32R to a pilot pressure lower than the pilot pressure applied to the other of the inlet ports of the shuttle valve 32R by the hydraulic pressure control valve 31R. Therefore, the controller 30 can control the hydraulic pressure control valve 31R and the hydraulic pressure control valve 33R to reliably apply the desired pilot pressure to the pilot port on the right side of the control valve 17A.

In this manner, the hydraulic pressure control valves 33L and 33R can forcibly reduce or stop the motion of the hydraulic actuator HA corresponding to the operating state of the lever device 26A. Furthermore, the hydraulic pressure control valves 33L, 33R can reduce the pilot pressure applied to one of the inlet ports of the shuttle valves 32L, 32R, and can assist in ensuring that the pilot pressure of the hydraulic pressure control valves 31L, 31R is applied to the pilot port of the control valve 17A through the shuttle valves 32L, 32R.

The controller 30 may control the hydraulic pressure control valve 31R instead of the hydraulic pressure control valve 33L to forcibly reduce or stop the movement of the boom cylinder 7 in the first direction corresponding to the tilting operation of the lever device 26A in the first direction. For example, when the lever device 26A is tilted in the first direction, the controller 30 may control the hydraulic pressure control valve 31R to apply a predetermined pilot pressure from the hydraulic pressure control valve 31R to the pilot port on the right side of the control valve 17A through the shuttle valve 32R. Thus, the pilot pressure is applied to the pilot port on the right side of the control valve 17A against the pilot pressure applied to the pilot port on the left side of the control valve 17A from the lever device 26A through the shuttle valve 32L. Therefore, the controller 30 can forcibly bring the control valve 17A to a position closer to the neutral position to reduce or stop the motion of the hydraulic actuator HA corresponding to the tilting operation of the lever device 26A in the first direction. Likewise, instead of controlling the hydraulic pressure control valve 33R, the controller 30 may control the hydraulic pressure control valve 31L to forcibly reduce or stop the motion of the hydraulic actuator HA in the second direction corresponding to the tilting operation of the lever device 26A in the second direction. In this case, the hydraulic pressure control valves 33L, 33R may be omitted.

The controller 30 can supply the hydraulic oil discharged from the pilot pump 15 to the pilot port on the left side of the control valve 17A through the hydraulic pressure control valve 31L and the shuttle valve 32L regardless of the operator's operation of the lever device 26A in the first direction. The controller 30 can also supply hydraulic oil discharged from the pilot pump 15 to the pilot port on the right side of the control valve 17A through the hydraulic pressure control valve 31R and the shuttle valve 32R regardless of the operator's operation of the lever device 26A in the second direction.

In this manner, the controller 30 can achieve the automatic operation function, the remote operation function, and the like of the shovel 100 by automatically controlling the motion of the hydraulic actuator in the two opposing directions.

<Another Example of Configuration of Operation System>

Figure 7:
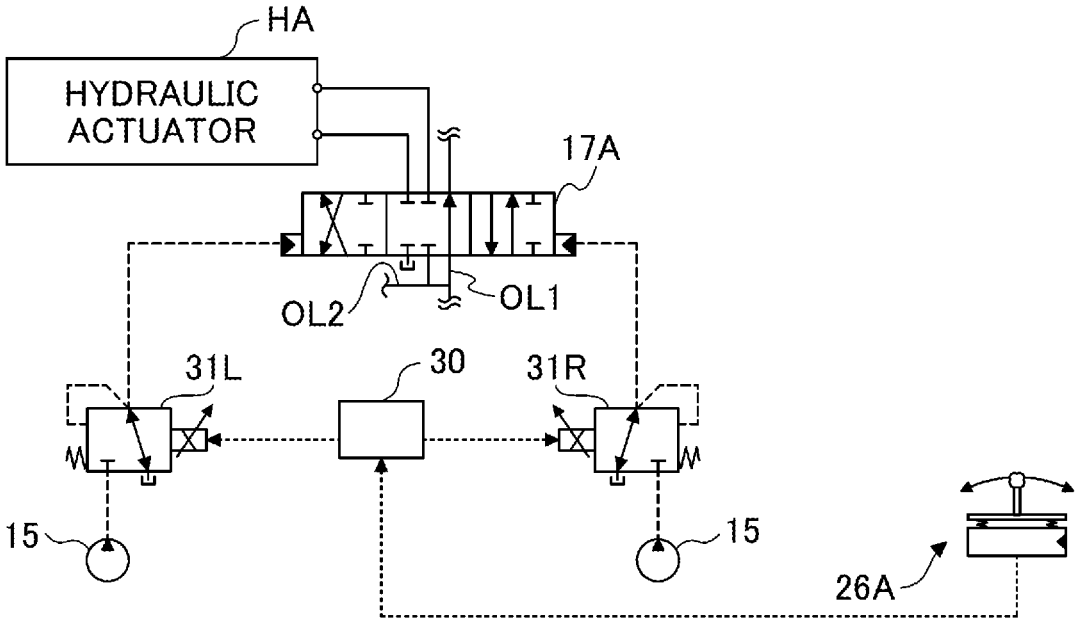
FIG. 7 is a drawing illustrating another example of configuration of an operation system of a shovel.

FIG. 7 is a drawing illustrating another example of configuration of an operation system of the shovel 100. Specifically, FIG. 7 is a drawing corresponding to the shovel 100 of FIG. 5 and illustrating a pilot circuit that supplies hydraulic oil to the hydraulic actuator HA and applies a predetermined pilot pressure to the control valve 17A for discharging hydraulic oil from the hydraulic actuator HA. Hereinafter, difference from the above-described example (FIG. 6) is mainly explained below.

The lever device 26A is configured so that the operator can tilt the lever device 26A in two opposing directions (for example, in the longitudinal or lateral direction). The lever device 26A outputs an electric signal (an operation signal) corresponding to operation contents in the two opposing directions, and the output operation signal is received by the controller 30.

In the controller 30, a correspondence relationship between the amount of operation (For example, the tilt angle of the lever device 26A) of the operation apparatus 26 and the control signal (the control current) to the hydraulic pressure control valves 31L, 31R is preset. The hydraulic pressure control valves 31L, 31R corresponding to the lever device 26A are controlled based on the correspondence relationship that is preset.

The hydraulic pressure control valve 31L operates according to a control signal (control current) input from the controller 30. Specifically, the hydraulic pressure control valve 31L outputs the pilot pressure corresponding to the control current input from the controller 30 to the pilot port on the left side of the control valve 17A by using hydraulic oil discharged from the pilot pump 15. Thus, the hydraulic pressure control valve 31L can adjust the pilot pressure applied to the pilot port on the left side of the control valve 17A. For example, when a control current corresponding to the tilting operation of the lever device 26A in the first direction is input from the controller 30, the hydraulic pressure control valve 31L can apply the pilot pressure corresponding to the operation contents (the amount of operation) of the lever device 26A to the pilot port on the left side of the control valve 17A. The predetermined control current is input from the controller 30 regardless of the operation contents of the lever device 26A, the hydraulic pressure control valve 31L can apply the pilot pressure to the pilot port on the left side of the control valve 17A regardless of the operation contents of the lever device 26A.

The hydraulic pressure control valve 31R operates according to a control signal (a control current) input from the controller 30. Specifically, the hydraulic pressure control valve 31R outputs the pilot pressure corresponding to the control current input from the controller 30 to the pilot port on the right side of the control valve 17A by using hydraulic oil discharged from the pilot pump 15. Thus, the hydraulic pressure control valve 31R can adjust the pilot pressure applied to the pilot port on the right side of the control valve 17A. For example, when a control current corresponding to the tilting operation of the lever device 26A in the second direction is input from the controller 30, the hydraulic pressure control valve 31R can apply the pilot pressure corresponding to the operation contents (the amount of operation) of the lever device 26A to the pilot port on the right side of the control valve 17A. When the predetermined control current is input from the controller 30 regardless of the operation contents of the lever device 26A, the hydraulic pressure control valve 31R can apply the pilot pressure to the pilot port on the right side of the control valve 17A regardless of the operation contents of the lever device 26A.

In this manner, the hydraulic pressure control valves 31L, 31R can adjust the pilot pressure output to the secondary side so that the control valve 17A can be stopped at any valve position according to the operating state of the lever device 26A under the control of the controller 30. Under the control of the controller 30, the hydraulic pressure control valves 31L, 31R can adjust the pilot pressure output to the secondary side so that the control valve 17A can be stopped at any valve position regardless of the operating state of the lever device 26A.

The controller 30 controls the hydraulic pressure control valve 31L according to an operation signal, a remote operation signal, or the like corresponding to the operation of the hydraulic actuator HA in the first direction by the operator. Thus, the controller 30 can supply the pilot pressure corresponding to the contents (the amount of operation) of the operation of the hydraulic actuator HA in the first direction by the operator to the pilot port on the left side of the control valve 17A. The controller 30 controls the hydraulic pressure control valve 31R according to an operation signal corresponding to the operation by the operator, a remote operation signal, or the like. Thus, the controller 30 can supply the pilot pressure corresponding to the contents (the amount of operation) of the operation of the hydraulic actuator HA in the second direction by the operator to the pilot port on the right side of the control valve 17A.

In this manner, the controller 30 controls the hydraulic pressure control valves 31L and 31R according to the operation signal output from the lever device 26A and the remote operation signal received by the communication apparatus T1, thereby achieving the motion of the hydraulic actuator HA according to the operation contents of the operator.

The controller 30 can control the hydraulic pressure control valve 31L and supply hydraulic oil discharged from the pilot pump 15 to the pilot port on the left side of the control valve 17A regardless of the operation of the hydraulic actuator HA in the first direction by the operator. The controller 30 can control the hydraulic pressure control valve 31R and supply hydraulic oil discharged from the pilot pump 15 to the pilot port on the right side of the control valve 17A regardless of the operation of the hydraulic actuator HA in the second direction by the operator.

In this manner, the controller 30 can automatically control the motion of the hydraulic actuator in the two opposing directions, thereby achieving the automatic operation function, the remote operation function, and the like of the shovel 100.

In addition, the controller 30 may control the hydraulic pressure control valve 31R when it is determined that a braking operation for decelerating or stopping the hydraulic actuator HA is necessary in a state where the operator operates the hydraulic actuator HA in the first direction. Specifically, the controller 30 may apply the predetermined pilot pressure from the hydraulic pressure control valve 31R to the pilot port on the right side of the control valve 17A in a state where the hydraulic actuator HA is operated in the first direction. Thus, the pilot pressure is applied to the pilot port on the right side of the control valve 17A against the pilot pressure applied to the pilot port on the left side of the control valve 17A from the hydraulic pressure control valve 31L according to the motion of the hydraulic actuator HA in the first direction. Therefore, the controller 30 can forcibly move the spool of the control valve 17A to a position closer to the neutral position to reduce or stop the motion of the hydraulic actuator HA corresponding to the operation of the hydraulic actuator HA in the first direction by the operator. Likewise, the controller 30 may control the hydraulic pressure control valve 31L when it is determined that a braking operation for decelerating or stopping the hydraulic actuator HA is necessary in a state where the operator operates the hydraulic actuator HA in the second direction. Thus, the controller 30 can reduce or stop the motion of the hydraulic actuator HA corresponding to the operation of the hydraulic actuator HA in the second direction by the operator by forcibly bringing the spool of the control valve 17A closer to the neutral position.

Furthermore, as described above, the hydraulic pressure control valves 33L, 33R may be provided in the pilot line between each of the hydraulic pressure control valves 31L, 31R and the pilot port of the control valve 17A.

For example, the hydraulic pressure control valve 33L is provided in the pilot line between the hydraulic pressure control valve 31L and the pilot port on the left side of the control valve 17A. For example, the controller 30 controls the hydraulic pressure control valve 33L when it is determined that a braking operation for decelerating or stopping the hydraulic actuator HA is necessary in a state where the operator operates the hydraulic actuator HA in the first direction. Specifically, the controller 30 reduces the pilot pressure by discharging, with the hydraulic pressure control valve 33L, hydraulic oil in the pilot line between the hydraulic pressure control valve 31L and the pilot port on the left side of the control valve 17A to the tank. Thus, the spool of the control valve 17A can be moved in the neutral direction regardless of the state of the hydraulic pressure control valve 31L. Therefore, the hydraulic pressure control valve 33L can improve the braking characteristics with respect to the motion of the hydraulic actuator HA in the first direction.

The hydraulic pressure control valve 33R is provided, for example, in a pilot line between the hydraulic pressure control valve 31R and a pilot port on the right side of the control valve 17A. The controller 30 controls the hydraulic pressure control valve 33R when it is determined that a braking operation for decelerating or stopping the hydraulic actuator HA is necessary in a state where, for example, an operator operates the hydraulic actuator HA in the second direction. Specifically, the controller 30 reduces the pressure of the pilot line by discharging, with the hydraulic pressure control valve 33R, the hydraulic oil of the pilot line between the hydraulic pressure control valve 31R and the pilot port on the right side of the control valve 17A to the tank. Thus, the spool of the control valve 17A can be moved in the neutral direction regardless of the state of the hydraulic pressure control valve 31R. Therefore, the hydraulic pressure control valve 33R can improve the braking characteristics with respect to the motion of the hydraulic actuator HA in the second direction.

[Example of Automatic Operation Function of Shovel]

Next, a specific example of an automatic operation function (machine control function) of the shovel 100 is described with reference to FIGS. 8 to 11.

Figure 8:
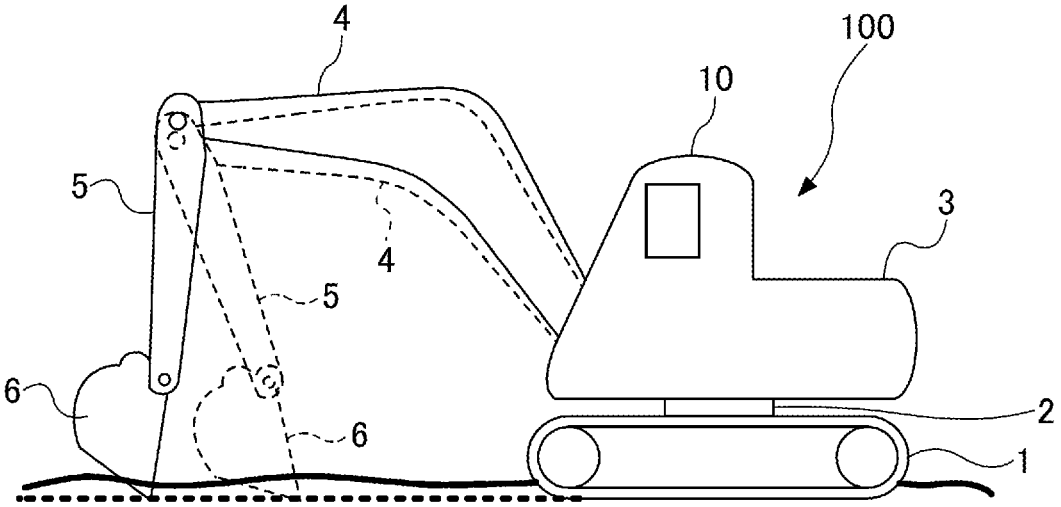
FIG. 8 is a drawing illustrating an example of an excavation motion along a construction target surface by a shovel.
Figure 9:
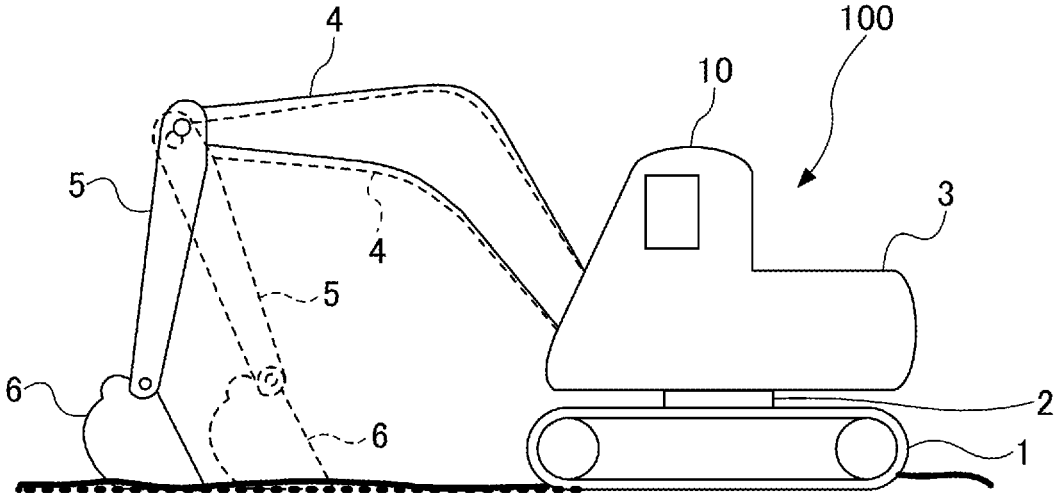
FIG. 9 is a drawing illustrating an example of a finishing motion along a construction target surface by a shovel.
Figure 10:
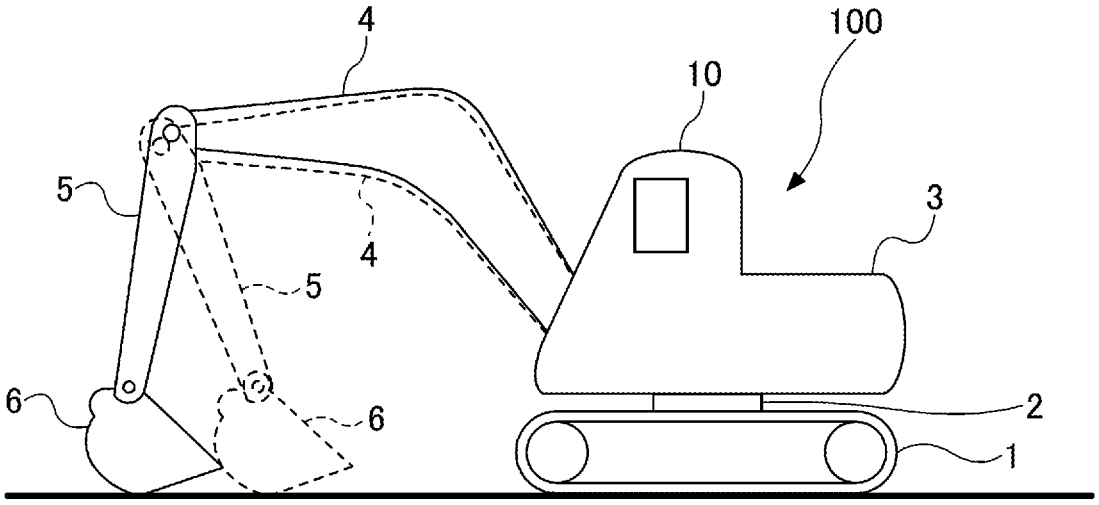
FIG. 10 is a drawing illustrating an example of a compaction motion along a construction target surface by a shovel.
Figure 11:
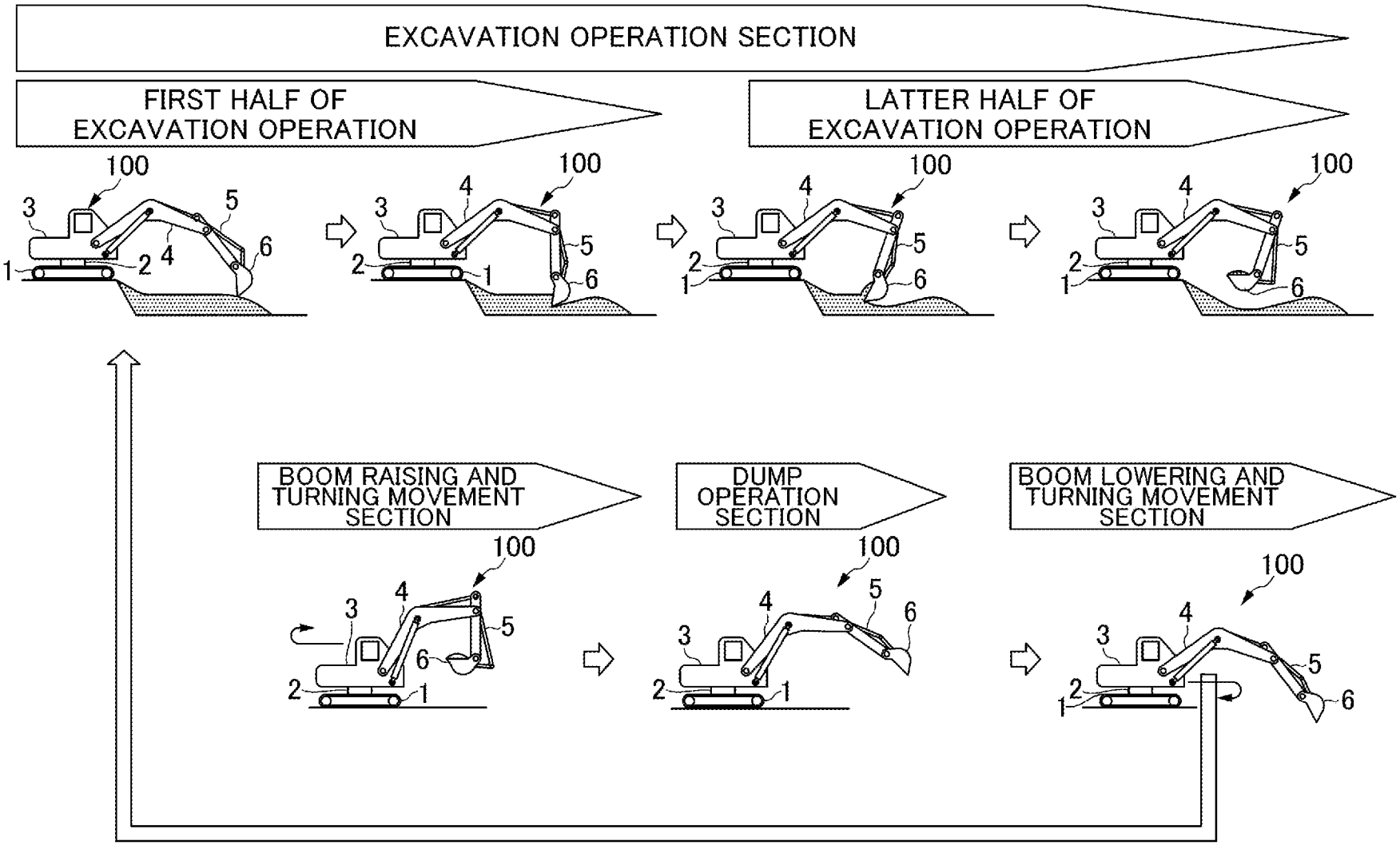
FIG. 11 is a drawing for explaining loading work by a shovel.

FIG. 8 is a drawing illustrating an example of construction work along the construction target surface of the shovel 100. FIG. 9 is a drawing illustrating an example of finishing work along a construction target surface of the shovel 100. FIG. 10 is a drawing illustrating an example of a compaction work along a construction target surface of the shovel 100. FIG. 11 is a drawing for explaining loading work of the shovel 100.

The controller 30 automatically moves an actuator that drives a driven element of the shovel 100, thereby providing a semi-automatic operation function of the shovel 100 in such a manner as to support the manual motion of the shovel 100 by the operator. Specifically, as described above, the controller 30 controls the hydraulic pressure control valves 31 to individually and automatically adjust the pilot pressure applied to the control valves 17A in the control valve unit 17 corresponding to the plurality of hydraulic actuators. Thereby, the controller 30 can automatically move the respective hydraulic actuators according to the operation of the operator.

Control of the semi-automatic operation function by the controller 30 may be performed, for example, when a predetermined switch included in the input apparatus 72 is depressed. The predetermined switch may be, for example, a knob switch NS provided at the tip of the grip portion of the lever device 26A corresponding to the operation of the arm 5 by the operator. Furthermore, in the case where the shovel 100 is remotely operated, the machine control function (the semi-automatic operation function) may be enabled when the operation apparatus for the remote operation is operated while a similar knob switch installed in the operation apparatus for the remote operation used by the operator is depressed. Hereinafter, description will be made based on the assumption that the semi-automatic operation function of the shovel 100 is effective when the knob switch NS of the lever device 26A or a knob switch (hereinafter referred to as an MC (machine control) switch for convenience) of the operation apparatus for the remote operation is depressed.

For example, the controller 30 may activate the automatic operation function to support excavation work, finishing work, compaction work, and the like of the shovel 100 performed by the operation of the operator. Specifically, the controller 30 may automatically move (extend or retract) at least one of the boom cylinder 7 and the bucket cylinder 9 in synchronization with the motion (extension or retraction) of the arm cylinder 8 based on the operation of the operator. For example, when the operator manually closes the arm 5 (hereinafter referred to as "arm closing operation"), the controller 30 may automatically extend or retract (synchronously move) at least one of the boom cylinder 7 and the bucket cylinder 9 so that a predetermined construction target surface coincides with the work portion (for example, the claw tip or on the back surface) of the bucket 6. Thus, the operator can synchronously move at least some of the boom 4, the arm 5, and the bucket 6 so that the claw tip or the back surface of the bucket 6 coincides with the construction target surface by performing only the arm closing operation. For example, as illustrated in FIG. 8, under the control of the controller 30, the shovel 100 synchronously moves at least some of the boom 4, the arm 5, and the bucket 6 to perform an excavation motion in such a manner that the claw tip of the bucket 6 is moved along the construction target surface while the claw tip of the bucket 6 is kept perpendicular to the ground. For example, as illustrated in FIG. 9, under the control of the controller 30, the shovel 100 performs a finishing motion in such a manner that at least some of the boom 4, the arm 5, and the bucket 6 are synchronously moved, and the claw tip of the bucket 6 is moved along the construction target surface while the claw tip of the bucket 6 is parallel to the ground. For example, as illustrated in FIG. 10, under the control of the controller 30, the shovel 100 performs a compaction motion in such a manner that at least some of the boom 4, the arm 5, and the bucket 6 are synchronously moved, and the back surface (in this example, a curved portion in a side view) of the bucket is moved along the construction target surface. Therefore, the shovel 100 can perform an excavation motion, finishing motion, compaction motion, and the like for constructing the construction target surface by synchronously moving at least some of the boom cylinder 7, the arm cylinder 8, and the bucket cylinder 9 according to a manual operation of the arm cylinder 8 by the operator. Similarly, for example, when the operator manually opens the arm 5 (hereinafter referred to as an "arm opening operation"), the controller 30 may automatically extend or retract (synchronously move) at least one of the boom cylinder 7 and the bucket cylinder 9 so that the construction target surface coincides with the work portion (for example, the back surface) of the bucket 6. Thus, the operator can synchronously move at least some of the boom 4, the arm 5, and the bucket 6 so that the claw tip and the back surface of the bucket 6 coincides with the construction target surface by performing only the arm opening operation. Therefore, the shovel 100 can perform a finishing motion, compaction motion, or the like for constructing the construction target surface by synchronously moving at least some of the boom cylinder 7, the arm cylinder 8 and the bucket cylinder 9 according to the operation of the arm cylinder 8 by the operator.

The data related to the construction target surface is previously stored (registered) in, for example, an internal memory (for example, a non-volatile auxiliary storage device) of the controller 30, an external storage device readable and writable from the controller 30, or the like. The data of the construction target surface is expressed by the World Geodetic System. The World Geodetic System is a three-dimensional orthogonal XYZ coordinate system in which the origin is at the center of gravity of the earth, the X-axis passes through the intersection of the Greenwich meridian and the equator, the Y-axis passes through 90 degrees east longitude, and the Z-axis passes through the north pole. The construction target surface may be set, for example, at any given point on the construction site as a reference point according to an input from the operator with the input apparatus 72 or the like, and may also be set based on a relative positional relationship with respect to the reference point. The data relating to the construction target surface may be downloaded from a predetermined external apparatus through the communication apparatus T1.

For example, the controller 30 may operate an automatic operation function to support the loading work of the shovel 100 by the operation of the operator. Specifically, the controller 30 may automatically synchronously move other actuators in synchronization with the operation of a hydraulic actuator in each operation process (see FIG. 11) of an excavation motion, a boom raising and turning motion, an earth unloading (dump) motion, and a boom lowering and turning motion included in loading work.

For example, the controller 30 may automatically move (extend or retract) at least one of the boom cylinder 7 and the bucket cylinder 9 in synchronization with the motion (extension or retraction) of the arm cylinder 8 based on the operation of the operator during the excavation motion process in the loading work. For example, the controller 30 may determine that the excavation motion process of the shovel 100 is being performed during a period from when a start condition of the excavation motion process is satisfied to when an end condition is satisfied. The start condition of the excavation motion process may be, for example, "the closing operation of the arm 5 starts in a state where the work portion (for example, the claw tip) of the bucket 6 is at a predetermined excavation start position (range)". The end condition of the excavation motion process may be, for example, "the bucket 6 lifts off from the ground after the motion of scooping the earth". For example, when the arm closing operation is manually performed by the operator, the controller 30 may automatically extend or retract (synchronously move) at least one of the boom cylinder 7 and the bucket cylinder 9 so that a target trajectory generated in advance coincides with the work portion (for example, the claw tip) of the bucket 6. The target trajectory is a target of the trajectory of the work portion of the bucket 6 for scooping up earth from a pile of earth. For example, the controller 30 may recognize a pile of earth based on the output or the like of the space recognition apparatus 70, and generate the target trajectory in view of the amount of earth in the pile of earth. Thus, the operator can synchronously move at least some of the boom 4, the arm 5, and the bucket 6 so that the bucket 6 scoops the earth from the pile of the earth by performing only the arm closing operation. Therefore, the shovel 100 can perform excavation motion for scooping earth from the pile of the earth by synchronously moving at least some of the boom cylinder 7, the arm cylinder 8, and the bucket cylinder 9 according to the operation of the arm cylinder 8 by the operator.

Furthermore, the controller 30 may, for example, automatically move (extend) the boom cylinder 7 in synchronization with the turning motion of the upper turning body 3 based on the operation of the operator during the boom raising and turning motion process in the loading work. For example, the controller 30 may determine that the shovel 100 is in the boom raising and turning motion process during a period from when a start condition of the boom raising and turning motion process is satisfied to when an end condition is satisfied. The start condition of the boom raising and turning motion process may be that, for example, "the end condition of the excavation motion process is satisfied and the operation (hereinafter referred to as a "turning operation") of the upper turning body 3 is started". The end condition of the boom raising and turning motion process may be that, e.g., "the predetermined work portion (for example, the claw tip or on the back surface) of the bucket 6 has reached a predetermined range directly above the truck bed of the truck on which the earth is to be loaded". For example, when the operator manually performs the turning operation, the controller 30 may automatically move (extend) the boom cylinder 7 so that the target trajectory generated in advance coincides with the work portion of the bucket 6. The target trajectory is a target of the trajectory of the work portion of the bucket 6 for moving the bucket 6 to a position above the truck bed of the truck without bringing the bucket 6 into contact with the truck bed or the like. The controller 30 may, for example, recognize the position and shape of the truck based on the output of the space recognition apparatus 70 and generate a target of a trajectory of the work portion of the bucket 6 to the position above the truck bed. Thereby, the operator can synchronously move the upper turning body 3 and the boom 4 so that the bucket 6 moves to the position above the truck bed of the truck by performing only the turning operation. Therefore, the shovel 100 can perform the boom raising and turning motion for moving the earth scooped in the bucket 6 to the truck bed of the truck by synchronously moving the turning hydraulic motor 2A and the boom cylinder 7 according to the motion of the turning hydraulic motor 2A by the operator.

Furthermore, for example, the controller 30 may automatically move (retract) the arm cylinder 8 in synchronization with the motion of the bucket 6 based on the operation of the operator during the earth unloading motion of the loading work. The controller 30 may automatically synchronously move not only the arm cylinder 8 but also the boom cylinder 7 according to the motion of the bucket 6. For example, the controller 30 may determine that the earth unloading motion process of the shovel 100 is being performed during a period from when a start condition of the earth unloading motion process is satisfied to when an end condition is satisfied. The start condition of the earth unloading motion process may be that, for example, "the end condition of the boom raising and turning motion process is satisfied and the opening motion of the bucket 6 (hereinafter referred to as a "bucket opening motion") is started". The end condition of the earth unloading motion process may be that, e.g., "the opening motion of the bucket 6 is finished". For example, when the bucket opening operation is manually performed by an operator, the controller 30 may automatically move (retract) the arm cylinder 8 so that a target trajectory generated in advance coincides with the work portion (for example, the claw tip or on the back surface) of the bucket 6. The target trajectory is a target of the trajectory of the work portion of the bucket 6 for unloading earth in the bucket 6 to a predetermined position of the truck bed of the truck. The controller 30 may, for example, recognize the shape of the truck bed of the truck, the shape of earth on the truck bed, and the like, based on the output of the space recognition apparatus 70, and may generate the target trajectory of the work portion of the bucket 6. Thus, the operator can synchronously move the arm 5 and the bucket 6 so that the earth stored in the bucket 6 is unloaded to the predetermined position of the truck bed of the truck by performing only the bucket opening operation. Therefore, the shovel 100 can perform the earth unloading motion for unloading the earth stored in the bucket 6 to the truck bed of the truck by synchronously moving the arm cylinder 8, the bucket cylinder 9, and the like according to the motion of the bucket cylinder 9 by the operator.

Furthermore, for example, the controller 30 may automatically move (retract) the boom cylinder 7 in synchronization with the turning motion of the upper turning body 3 based on the operation of the operator during the boom lowering and turning motion process in the loading work. For example, the controller 30 may determine that the boom lowering and turning motion process of the shovel 100 is being performed during a period from when the start condition of the boom lowering and turning motion process is satisfied to when the end condition is satisfied. The start condition of the boom raising and turning motion process may be that, for example, "the end condition of the earth unloading motion process is satisfied and the operation (hereinafter referred to as a "turning operation") of the upper turning body 3 is started". The end condition of the boom lowering and turning motion process may be that, e.g., "the predetermined work portion (for example, the claw tip) of the bucket 6 has reached the excavation start position (range)". For example, when the operator manually performs the turning operation, the controller 30 may automatically move (retract) the boom cylinder 7 so that the target trajectory generated in advance coincides with the work portion of the bucket 6. The target trajectory is a target of the trajectory of the work portion of the bucket 6 for moving the bucket 6 from the truck bed to the excavation start position without bringing the bucket 6 into contact with the truck bed or the like. The controller 30 may, for example, recognize the position and the shape of the truck, the position and the shape of the pile of earth, and the like, based on the output of the space recognition apparatus 70, and may generate a target trajectory of the work portion of the bucket 6 from the top of the truck bed to the excavation start position. Thus, the operator can synchronously move the upper turning body 3, the boom 4, and the like so that the bucket 6 moves from the truck bed of the truck to the excavation start position by performing only the turning operation. Therefore, the shovel 100 can perform the boom lowering and turning motion for moving the bucket 6 to the excavation start position by synchronously moving the turning hydraulic motor 2A and the boom cylinder 7 according to the motion of the turning hydraulic motor 2A by the operator.

[Control Processing of Controller]

Next, control processing of the controller 30 is described with reference to FIGS. 12 to 18.

<Example of Control Processing of Controller>

Figure 12:
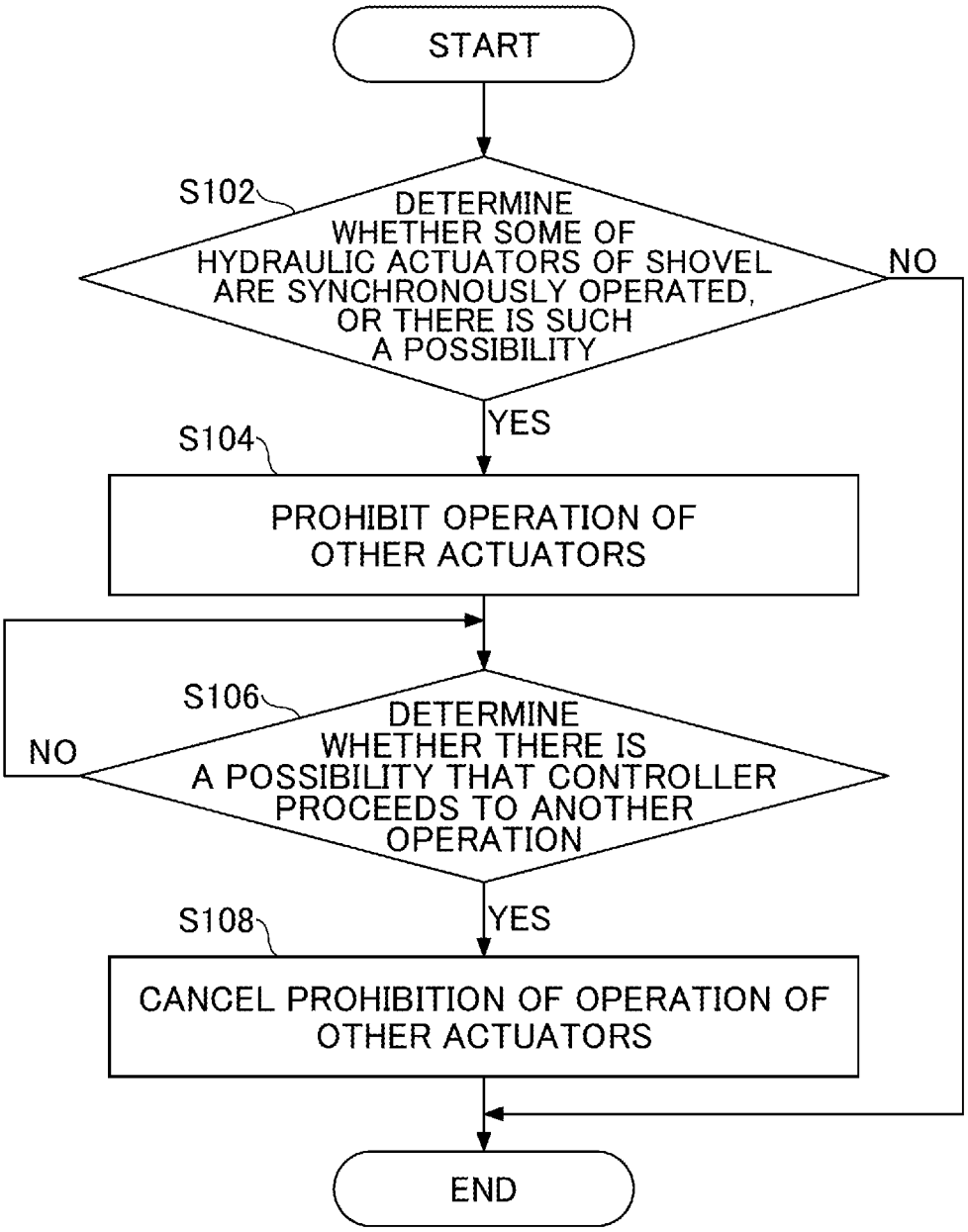
FIG. 12 is a drawing illustrating an example of control processing by a controller.

FIG. 12 is a drawing illustrating an example of control processing by the controller 30. FIG. 13 is a drawing for explaining actuator groups that move synchronously according to motion contents of the shovel 100, and actuators of which the motions are prohibited. This flowchart is repeatedly executed at predetermined time intervals from the start (for example, turning ON of the key switch) to the stop (for example, turning OFF of the key switch) of the shovel 100. The same applies to FIGS. 14 and 15.

In step S102, the controller 30 determines whether some of the hydraulic actuators (2 or more hydraulic actuators) of the shovel 100 are synchronously moved.

For example, the controller 30 may determine that some of the hydraulic actuators are synchronously moved when the shovel 100 is performing the excavation motion, finishing motion, compaction motion, and the like, such that the bucket 6 is moved along the extension direction of the attachment AT in a plan view by manual operation by the operator. In this case, some of the hydraulic actuators are at least two or more of the boom cylinder 7, the arm cylinder 8, and the bucket cylinder 9. The controller 30 can find the operation contents (excavating motion, finishing motion, compaction motion, and the like) of the shovel 100 based on the motion contents of the operator, the output of the space recognition apparatus 70, the outputs of the sensors S1 to S5, and the like.

For example, the controller 30 may determine that some of the hydraulic actuators are synchronously moved when the shovel 100 is performing the boom raising and turning motion or the boom lowering and turning motion by manual operation by the operator. In this case, some of the hydraulic actuators are the turning hydraulic motor 2A and the boom cylinder 7. The controller 30 can find the motion contents (the boom raising and turning motion) of the shovel 100 based on the operation contents of the operator, the output of the space recognition apparatus 70, the outputs of the sensors S1 to S5, and the like.

Furthermore, for example, the controller 30 may determine that some of the hydraulic actuators are synchronously moved when the shovel 100 is performing the earth unloading motion by the manual operation by the operator. In this case, some of the hydraulic actuators are the arm cylinder 8 and the bucket cylinder 9. The controller 30 can find the motion contents (the earth unloading motion) of the shovel 100 based on the operation contents of the operator, the output of the space recognition apparatus 70, the outputs of the sensors S1 to S5, and the like.

For example, the controller 30 may determine that some of the hydraulic actuators are synchronously moved when the shovel 100 is performing the excavation motion, finishing motion, compaction motion, or the like by the semi-automatic operation function based on the arm operation by the operator as described above. In this case, some of the hydraulic actuators are at least two or more of the boom cylinder 7, the arm cylinder 8, and the bucket cylinder 9. The controller 30 can find the excavation motion or the like of the shovel 100 by the semi-automatic operation function based on whether the MC switch is depressed, whether the arm operation is performed by the operator, and the like.

Furthermore, for example, the controller 30 may determine that some of the hydraulic actuators are synchronously moved when the shovel 100 is performing the boom raising and turning motion or the boom lowering and turning motion by the semi-automatic operation function based on the turning operation by the operator as described above. In this case, some of the hydraulic actuators are the turning hydraulic motor 2A and the boom cylinder 7. The controller 30 can find the boom raising and turning motion and the boom lowering and turning motion of the shovel 100 by the semi-automatic operation function based on whether the MC switch is depressed, whether the turning operation is performed by the operator, and the like.

For example, the controller 30 may determine that some of the hydraulic actuators are synchronously moved when the shovel 100 is performing an earth unloading motion by the semi-automatic operation function based on the operation of the bucket 6 by the operator as described above. In this case, some of the hydraulic actuators are arm cylinders 8, bucket cylinders 9, and the like. The controller 30 can find the earth unloading motion of the shovel 100 by the semi-automatic operation function based on whether the MC switch is depressed, whether the bucket 6 is operated by the operator, and the like.

In the case where some of the hydraulic actuators are synchronously moved, the controller 30 proceeds to step S104, and in the other case, the controller 30 ends the process of this flowchart.

Furthermore, in step S102, the controller 30 may determine whether there is a possibility that some of the hydraulic actuators (2 or more hydraulic actuators) of the shovel 100 of the plurality of hydraulic actuators of the shovel 100 will be synchronously moved. Specifically, in step S102, the controller 30 may determine whether the shovel 100 is in a state in which some of the hydraulic actuators are synchronously moved or in a state in which there is a possibility that some of the hydraulic actuators will be synchronously moved. For example, the controller 30 may determine that there is a possibility that some of the hydraulic actuators will be synchronously moved when, for example, there is a possibility that the shovel 100 will proceed to various motions described above (the excavation motion, finishing motion, compaction motion, boom raising and turning motion, boom lowering and turning motion, earth unloading motion, and the like). In this case, in the case where some of the hydraulic actuators are synchronously moved or if there is a possibility that some of the hydraulic actuators will be synchronously moved, the controller 30 proceeds to step S104, and in the case where some of the hydraulic actuators are not synchronously moved and there is no such possibility, the controller 30 ends the process of this flowchart. The same may apply to the case of FIG. 15 described later.

In step S104, the controller 30 prohibits the motion of the other actuators different from the some of the hydraulic actuators.

For example, as illustrated in FIG. 13, the controller 30 may prohibit the motion of the turning hydraulic motor 2A when the shovel 100 is performing an excavation motion or the like by synchronously moving at least some of the boom cylinder 7, the arm cylinder 8, and the bucket cylinder 9. Furthermore, the controller 30 may prohibit the operation of the crawlers 1CL, 1CR. Thus, the controller 30 can prevent the upper turning body 3 from turning even if the operator erroneously performs a turning operation of the upper turning body 3 when the shovel 100 linearly excavates along the extending direction of the attachment AT in a plan view. Therefore, the controller 30 can prevent unnecessary excavation marks and the like from being left on the construction surface by the turning motion of the upper turning body 3 during the excavation motion, finishing motion, compaction motion, or the like of the shovel 100. Furthermore, the controller 30 makes it less likely that a lateral external force will be applied to the bucket 6 making the shovel 100 unstable due to the turning motion of the upper turning body 3 during the excavation motion, finishing motion, compaction motion, or the like of the shovel 100. Therefore, the controller 30 can alleviate the reduction in the work efficiency, work quality, safety, and the like due to an erroneous operations performed by the operator during the excavation motion or the like.

For example, as illustrated in FIG. 13, the controller 30 may prohibit the operation of at least one of the arm cylinder 8 and the bucket cylinder 9 when the shovel 100 is performing the boom raising (lowering) turning motion by synchronously moving the turning hydraulic motor 2A and the boom cylinder 7. Furthermore, the controller 30 may prohibit the operation of the crawlers 1CL, 1CR. Thus, the controller 30 can prevent the arm 5 and the bucket 6 from moving even if the operator is erroneously operating the arm 5 and the bucket 6 during the boom raising and turning motion of the shovel 100. Therefore, the controller 30 can make it less likely that the earth stored in the bucket 6 will be spilled by the motion of the arm 5 and the bucket 6 during the boom raising and turning motion of the shovel 100. Furthermore, the controller 30 can prevent the attachment AT from coming into proximity to objects in the surroundings due to the motion of the arm 5 and the bucket 6 during the boom raising (lowering) turning motion of the shovel 100. Therefore, the controller 30 can alleviate the reduction in the work efficiency and safety of the shovel 100 during the boom raising (lowering) turning motion of the shovel 100.

For example, as illustrated in FIG. 13, the controller 30 may prohibit the operation of at least one of the turning hydraulic motor 2A and the boom cylinder 7 when the shovel 100 is performing the earth unloading motion by synchronously moving the arm cylinder 8 and the bucket cylinder 9. Furthermore, the controller 30 may prohibit the operation of the crawlers 1CL, 1CR. Thus, the controller 30 can prevent the upper turning body 3 and the boom 4 from moving even if the operator performs a turning operation or an operation of the boom 4 during the earth unloading motion of the shovel 100. Therefore, the controller 30 can make it less likely that earth will be spilled to the outside of the truck bed by the motion of the upper turning body 3 and the boom 4 during the earth unloading motion of the shovel 100. Furthermore, the controller 30 can prevent the attachment AT from coming into proximity to the truck bed of the truck or the like due to the motion of the upper turning body 3 and the boom 4 during the earth unloading motion of the shovel 100. Therefore, the controller 30 can alleviate a reduction in the work efficiency and safety of the shovel 100 during the earth unloading motion of the shovel 100.

For example, the controller 30 may prohibit, even if the other hydraulic actuators are operated, the motion of the other hydraulic actuators by disabling the operation of the other hydraulic actuators. Specifically, in the case where the lever device 26A is of an electric type, the controller 30 may be configured not to output a control signal corresponding to the operation signal to the hydraulic pressure control valves 31L, 31R, even if an operation signal relating to another actuator is input from the lever device 26A. Furthermore, in the case where the lever device 26A is of a hydraulic pilot type, when another hydraulic actuator is operated with the lever device 26A, the controller 30 may control any one of the hydraulic pressure control valves 33L, 33R corresponding to the operation contents of the another hydraulic actuator. Thus, the pilot pressure of the pilot line on the secondary side of the lever device 26A can be reduced, and the operation of the lever device 26A relating to the another hydraulic actuator can be disabled. Furthermore, the controller 30 may be configured not to output a control signal corresponding to the remote operation signal to the hydraulic pressure control valves 31L, 31R even if the remote operation signal relating to another hydraulic actuator is received.

Further, for example, in the case where another hydraulic actuator is operated, the controller 30 may prohibit the operation of the another hydraulic actuator by applying the pilot pressure to the pilot port of the control valve 17A corresponding to an operation direction opposite to the operation direction in which the another hydraulic actuator is operated. Specifically, the controller 30 may control the hydraulic pressure control valve 31R and apply the pilot pressure from the hydraulic pressure control valve 31R to the pilot port on the right side of the control valve 17A when another hydraulic actuator is operated in the first direction. As a result, the pilot pressure can be applied from the hydraulic pressure control valve 31R to the pilot port on the right side of the control valve 17A against the pilot pressure applied to the pilot port on the left side of the control valve 17A according to the operation of the another hydraulic actuator in the first direction. Therefore, as described above, the spool of the control valve 17A corresponding to the another hydraulic actuator can be brought closer to the neutral state so that the another hydraulic actuator does not move. Likewise, the controller 30 may control the hydraulic pressure control valve 31L and apply the pilot pressure from the hydraulic pressure control valve 31L to the pilot port on the left side of the control valve 17A when another hydraulic actuator is operated in the second direction.

In the case where the motion of another actuator is prohibited, the controller 30 may notify the operator in the cab 10 of the prohibition through the display apparatus D1, the sound output device D2, or the like. When the shovel 100 is remotely operated, the controller 30 may transmit a signal including notification information indicating that the motion of the another actuator is prohibited to the external apparatus through the communication apparatus T1. Thus, the operator of the cab 10 or the operator of the external apparatus can recognize that the motion of the another actuator is prohibited.

In the case where the motion of another actuator is prohibited, the controller 30 may notify the operator in the cab 10 or the operator of the external apparatus when the another actuator is operated. Thus, the controller 30 can notify the operator of the prohibition of the motion of the another actuator only when it is necessary to notify the operator of the prohibition of the operation. Therefore, the operator is less likely to feel annoyed.

When the processing of step S104 is completed, the controller 30 proceeds to step S106.

In step S106, the controller 30 determines whether there is a possibility that the controller 30 will proceed from a motion, in which some of the hydraulic actuators are synchronously moved, to another motion.

For example, in the case where at least some of the boom cylinder 7, the arm cylinder 8, and the bucket cylinder 9 are synchronously moved to perform an excavation motion or the like, the controller 30 may determine that there is a possibility of proceeding to another motion when such a motion is completed. Specifically, the controller 30 may determine that when the bucket 6 moves toward the operator (the upper turning body 3) in synchronization with the excavation motion of the shovel 100 and the bucket 6 lifts off from the ground (moves away from the ground), there is a possibility that the current excavation motion is completed and the controller 30 proceeds to another motion.

For example, in the case where some of the hydraulic actuators are synchronously moved by the semi-automatic operation function, the controller 30 may determine that there is a possibility of proceeding to another motion when the semi-automatic operation function is cancelled. Specifically, the controller 30 may determine that there is a possibility of proceeding to another motion when the depression of the MC switch is released from the state in which the MC switch is depressed.

In the case where there is a possibility that the controller 30 will proceed from a motion, in which some of the hydraulic actuators are synchronously moved, to another motion, the controller 30 proceeds to step S108, and in the other case, the controller 30 repeats the processing of step S106.

In step S108, the controller 30 cancels the prohibition of the motion of the other hydraulic actuators and ends the processing of this flowchart.

Thus, in the present embodiment, the controller 30 can prevent another hydraulic actuator from moving in the case where some of the hydraulic actuators of the plurality of hydraulic actuators are synchronously moved.

<Another Example of Control Processing of Controller>

Figure 14:
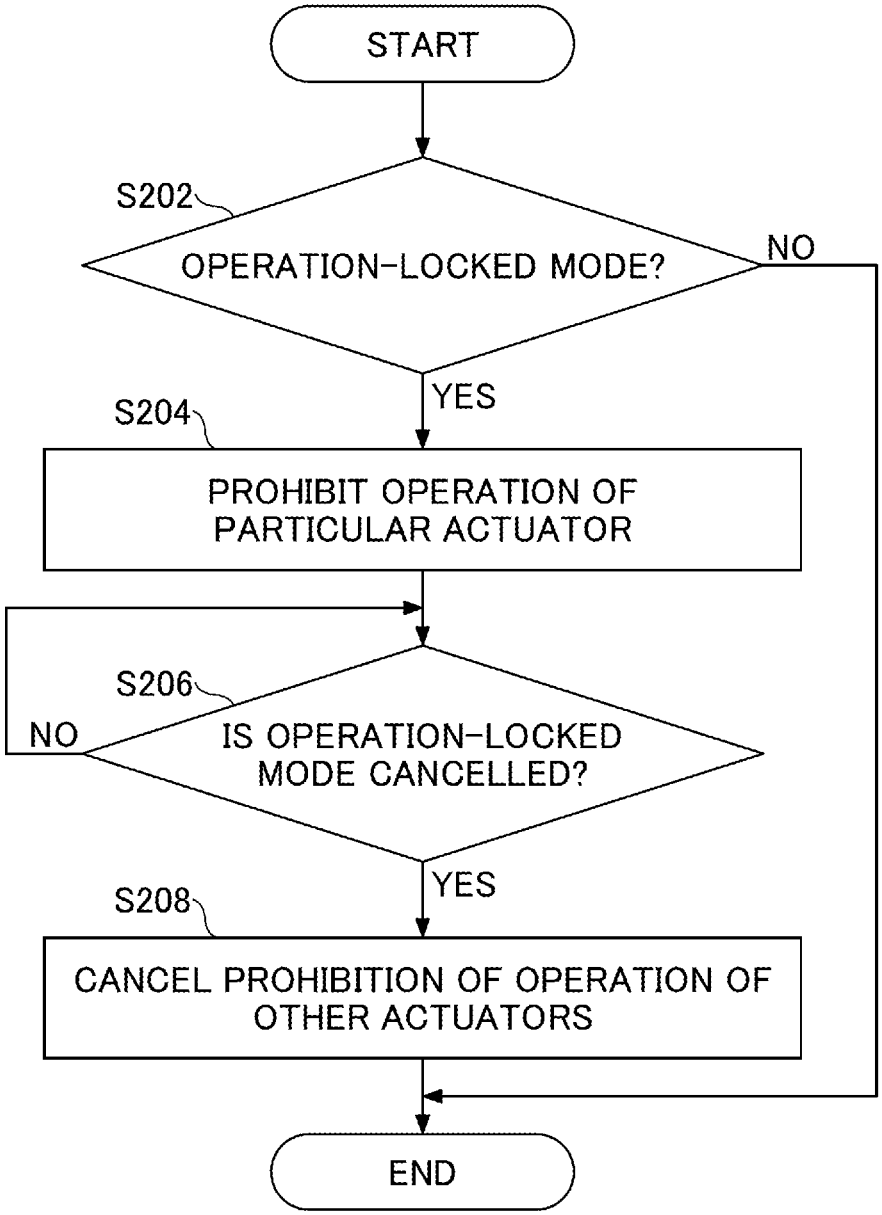
FIG. 14 is a drawing illustrating another example of control processing of a controller.

FIG. 14 is a drawing illustrating another example of control processing by the controller 30.

As illustrated in FIG. 14, in step S202, the controller 30 determines whether the motion mode of the shovel 100 is set to an "motion-locked mode". The motion-locked mode is a motion mode of the shovel 100 in which the motion of a specific hydraulic actuator of the plurality of hydraulic actuators is prohibited so that the motion of the hydraulic actuator is restricted from moving even when the hydraulic actuator is operated.

The motion-locked mode may be set, for example, according to a predetermined input by the operator with the input apparatus 72. In the case where the shovel 100 is remotely operated, the motion-locked mode may be set according to a predetermined input by the operator with the external apparatus. In this case, the external apparatus transmits a signal requesting setting of the motion-locked mode to the shovel 100 according to a predetermined input by the operator with the external apparatus, and the controller 30 may set the motion mode of the shovel 100 to the motion-locked mode upon receiving the signal.

A particular actuator of which the motion is prohibited in the motion-locked mode may be fixed in advance. The particular actuator of which the motion is prohibited in the motion-locked mode may be set (changed) according to a predetermined input by an operator with the input apparatus 72 or the like.

For example, the operator sets the motion mode of the shovel 100 to the motion-locked mode for prohibiting the motion of the turning hydraulic motor 2A with the input apparatus 72. Thus, when the operator causes the shovel 100 to perform an excavation motion for synchronously moving at least some of the boom cylinder 7, the arm cylinder 8, and the bucket cylinder 9, the operator can prevent the upper turning body 3 from turning due to an erroneous operation. Therefore, the controller 30 can alleviate the reduction in the work efficiency, work quality, safety and the like due to an erroneous operation by the operator during the excavation motion or the like.

In the case where the motion mode of the shovel 100 is the motion-locked mode, the controller 30 proceeds to step S204, and in the case where the motion mode of the shovel 100 is not the motion-locked mode, the controller 30 ends the current processing.

In step S204, the controller 30 prohibits the motion of the particular hydraulic actuator. The method for prohibiting the motion of the particular hydraulic actuator may be substantially the same as the method for prohibiting the motion of other hydraulic actuators in step S104 of the above-described example (FIG. 12).

When the processing of S204 is completed, the controller 30 proceeds to step S206.

In step S206, the controller 30 determines whether the motion-locked mode is cancelled. For example, in the case where a predetermined input for cancelling the motion-locked mode is received with the input apparatus 72, the controller 30 determines that the motion-locked mode is cancelled. For example, in the case where the shovel 100 is remotely operated, the controller 30 determines that the motion-locked mode is cancelled when a signal for requesting the cancellation of the motion-locked mode is received from the external apparatus. In this case, when the operator of the external apparatus performs a predetermined input for cancelling the motion-locked mode, the external apparatus transmits a signal requesting cancellation of the motion-locked mode to the shovel 100.

In the case where the motion-locked mode is cancelled, the controller 30 proceeds to step S208, and when the motion-locked mode is not cancelled, the controller repeats the processing of step S206.

In step S208, the controller 30 cancels the prohibition of the motion of the particular hydraulic actuator and ends the processing of this flowchart.

Thus, in this example, in the case where the motion mode of the shovel 100 is set to the motion-locked mode according to a predetermined input by the operator, the controller 30 can prevent a particular hydraulic actuator from moving.

<Still Another Example of Control Processing of Controller>

Figure 15:
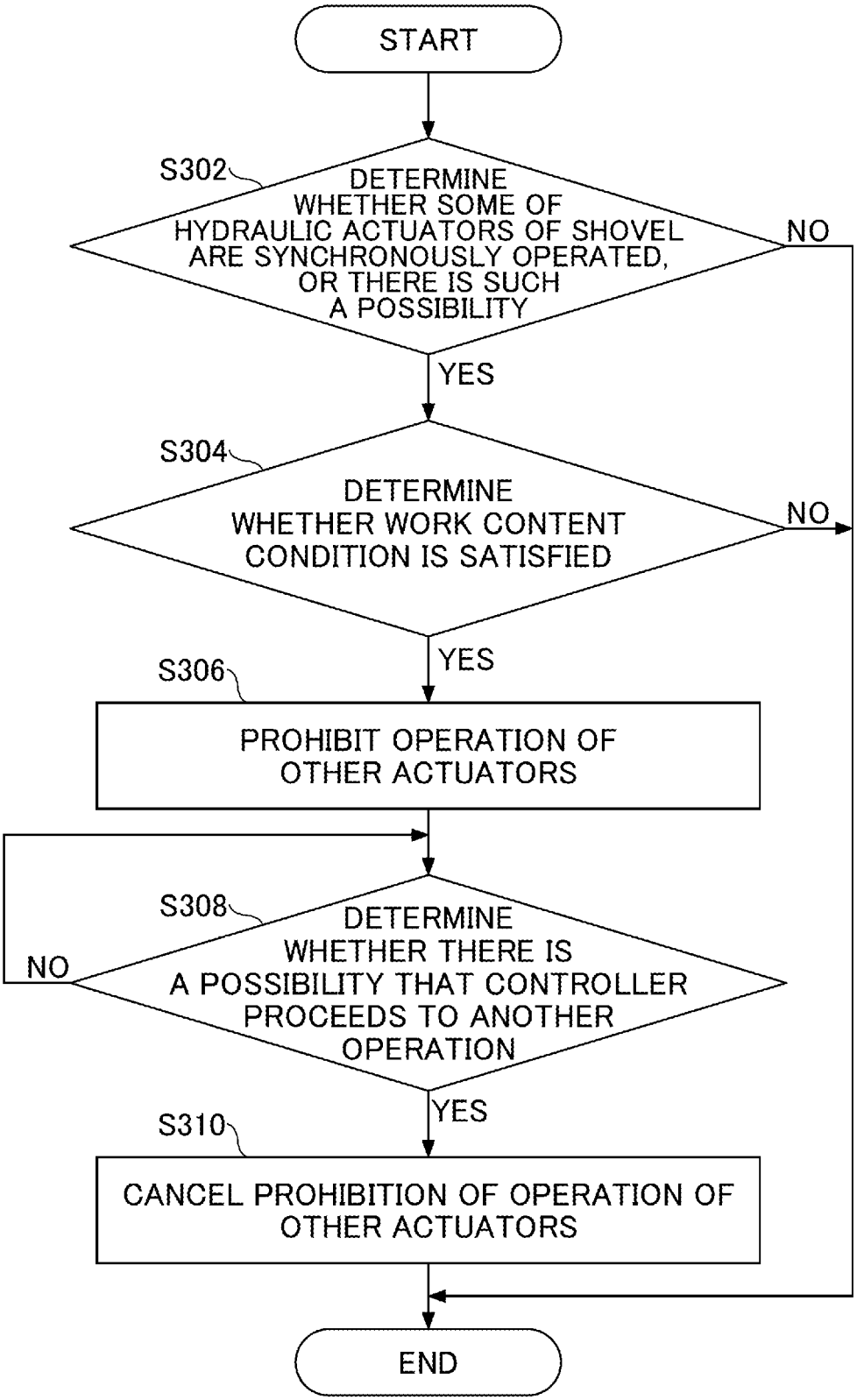
FIG. 15 is a drawing illustrating still another example of control processing of a controller.
Figure 16:
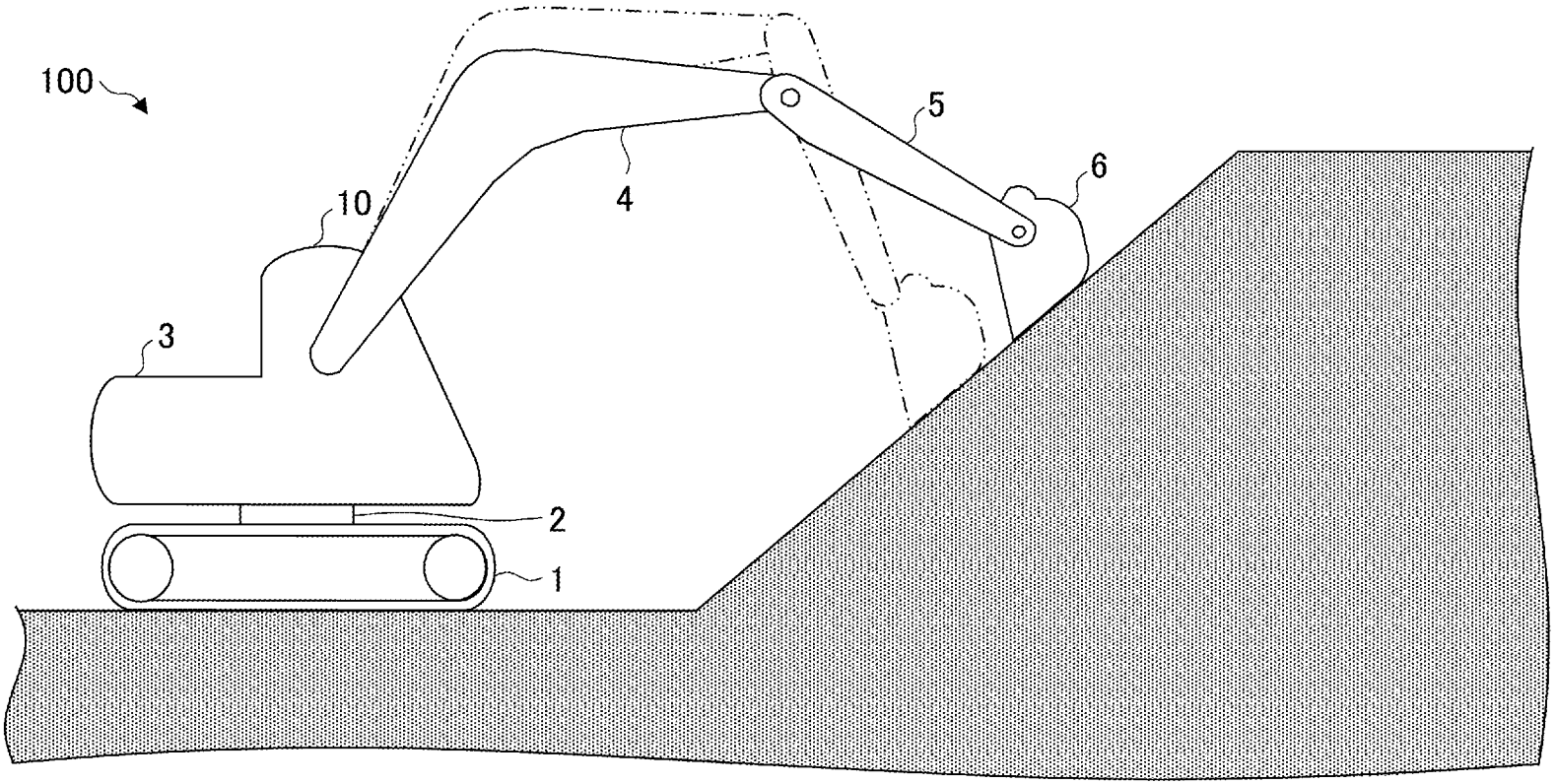
FIG. 16 is a drawing illustrating an example of construction work of a slope by a shovel.
Figure 17:
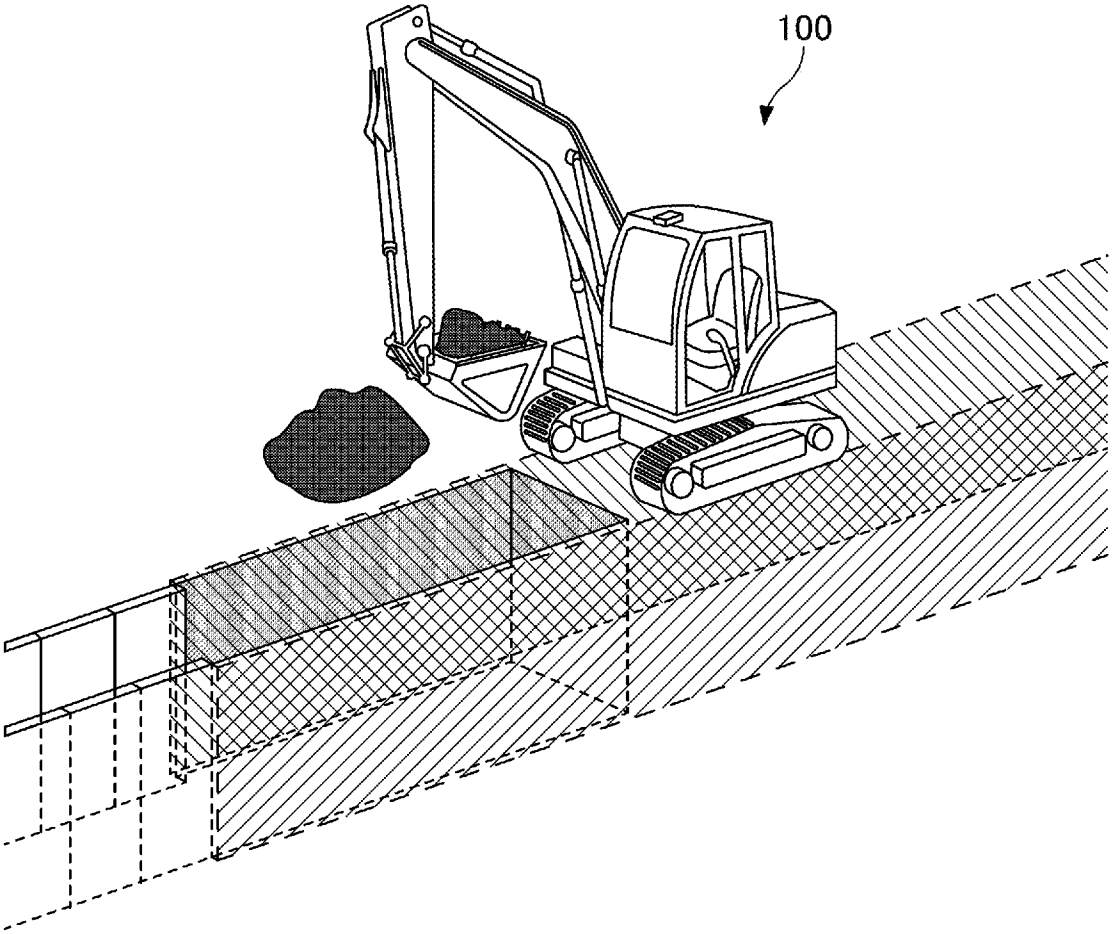
FIG. 17 is a drawing for explaining construction work of a trench surface by a shovel.

FIG. 15 is a drawing illustrating still another example of control processing by the controller 30. FIG. 16 is a drawing illustrating an example of construction work of a slope of the shovel 100. Specifically, FIG. 16 is a drawing illustrating an example of compaction work of a slope of the shovel 100. FIG. 17 is a drawing for explaining construction work of a trench by the shovel 100. Specifically, FIG. 17 is a drawing illustrating an example of construction work of a trench by the shovel 100. FIG. 18 is a drawing for explaining actuator groups that move synchronously during particular work, and actuators of which the motions are prohibited.

As illustrated in FIG. 15, the processing of step S302 is the same as the processing of step S102 in FIG. 12, and therefore explanation thereabout is omitted.

When the determination condition of step S302 is satisfied, the controller 30 proceeds to step S304.

In step S304, the controller 30 determines whether a work content condition is satisfied. The work content condition relates to the work content of the shovel 100 for prohibiting the motion of other hydraulic actuators. This is because, depending on the contents of the work, there may be cases where it is preferable to prohibit the operation of other hydraulic actuators different from the some of the hydraulic actuators synchronously moved, or cases where it is not necessary to prohibit the operation.

For example, the work content condition may include a condition that "at least some of the boom cylinder 7, the arm cylinder 8 and the bucket cylinder 9 are synchronously moved to perform finishing work on the construction target surface" (hereinafter referred to as a "first work content condition"). This is because, in the finishing work (see FIG. 9), if the upper turning body 3 turns, a scratch or the like is formed on the construction target surface, and the effect on the excavation quality is relatively greater as compared with the case of the excavation work or the like. In this case, the controller 30 may determine whether the first work content condition is satisfied based on the operation contents related to the attachment AT (for example, the operation contents related to the arm cylinder 8 in the semi-automatic operation function), the output of the space recognition apparatus 70, the outputs of the sensors S1 to S5, and the like.

For example, the work content condition may include a condition that "at least some of the boom cylinder 7, the arm cylinder 8, and the bucket cylinder 9 are synchronously moved to perform finishing work of the construction target surface based on data relating to the construction target surface defined by a two-dimensional straight line" (hereinafter referred to as a "second work content condition"). This is because, when at least some of the boom cylinder 7, the arm cylinder 8, and the bucket cylinder 9 are synchronously moved along the construction target surface defined by the two-dimensional straight line, there is a possibility that the shape in the width direction which is not defined as data is affected when the upper turning body 3 moves. In this case, the data on the construction target surface may be used for the semi-automatic operation function or for providing information to the operator through the display apparatus D1 (for example, machine guidance). The controller 30 may determine whether the second work content condition is satisfied based on the contents of data of the registered (set) construction target surface, the operation contents related to the attachment AT, the output of the space recognition apparatus 70, the outputs of the sensors S1 to S5, and the like. For example, the controller 30 may determine that the second work content condition is satisfied in the case where: at least some of the boom cylinder 7, the arm cylinder 8, and the bucket cylinder 9 are synchronously moved; the data relating to the construction target surface is defined by the two-dimensional straight line; the shovel 100 faces the straight line; and the amount of operation relating to the attachment AT is relatively small.

Furthermore, for example, the work content condition may include a condition that "at least some of the boom cylinder 7, the arm cylinder 8 and the bucket cylinder 9 are synchronously moved to perform construction work of a slope (see FIG. 16)" (hereinafter referred to as a "third work content condition"). This is because, when the upper turning body 3 turns in the construction work of a slope with the shovel 100 that faces the slope, the position of a predetermined portion of the bucket 6 is shifted from the slope defined as the construction target surface, and the construction quality may be greatly affected. In this case, the controller 30 may determine whether the third work content condition is satisfied based on: the contents of data of the registered (set) construction target surface, the operation contents related to the attachment AT, the output of the space recognition apparatus 70, the outputs of the sensors S1 to S5, and the like. For example, the controller 30 may determine that the third work content condition is satisfied in the case where: at least some of the boom cylinder 7, the arm cylinder 8, and the bucket cylinder 9 are synchronously moved; the data relating to the construction target surface is of a slope shape; the shovel 100 faces the slope (construction target surface), and the amount of operation relating to the attachment AT is relatively small.

Furthermore, for example, the work content condition may include a condition that "at least some of the boom cylinder 7, the arm cylinder 8 and the bucket cylinder 9 are synchronously moved to perform construction work of a trench (see FIG. 17)" (hereinafter referred to as a "fourth work content condition"). For example, the work content condition may include a condition that "at least some of the boom cylinder 7, the arm cylinder 8, and the bucket cylinder 9 are synchronously moved to perform construction work (excavating work, finishing work, and the like) of one end portion in the width direction of the trench" (hereinafter referred to as a "fifth work content condition"). This is because, when the construction work is progressed in the direction in which the trench extends by synchronously moving at least some of the boom cylinder 7, the arm cylinder 8, and the bucket cylinder 9 in the direction in which the trench extends, the bucket 6 may come into contact with the wall of the trench when the upper turning body 3 moves. In this case, the controller 30 may determine whether the fourth work content condition and the fifth work content condition are satisfied based on: the contents of data of the registered (set) construction target surface; the operation contents of the attachment AT; the output of the space recognition apparatus 70; the outputs of the sensors S1 to S5; and the like. For example, the controller 30 may determine that the fourth work content condition is satisfied in the case where: at least some of the boom cylinder 7, the arm cylinder 8, and the bucket cylinder 9 are synchronously moved; the data relating to the construction target surface is in a trench shape; the shovel 100 is oriented in the direction in which the trench extends; and the amount of operation relating to the attachment AT is relatively small. Further, for example, the controller 30 may determine that the fifth work content condition is satisfied in the case where at least some of the boom cylinder 7, the arm cylinder 8, and the bucket cylinder 9 are synchronously moved; the data relating to the construction target surface is in a trench shape; the shovel 100 is oriented in the direction in which the trench extends; the bucket 6 is located at the end of the trench; and the amount of operation relating to the attachment AT is relatively small.

In the case where the work content condition (where multiple work content conditions are included, one of them) is satisfied, the controller 30 proceeds to step S306, and in the other case, the controller 30 ends the processing of this flowchart.

In step S306, the controller 30 prohibits the motion of other actuators different from the some of the hydraulic actuators. The method of prohibiting the motion of other actuators may be the same as the case of step S104 of the above example (FIG. 12).

For example, as illustrated in FIG. 18, in the case where any one of the first work content condition to fifth work content condition described above is satisfied, the controller 30 prohibits the motion of the turning hydraulic motor 2A. Furthermore, the controller 30 may prohibit the operation of the crawlers 1CL, 1CR.

Furthermore, for example, in the case where the above-described fifth work content condition is satisfied, the controller 30 may prohibit, from among the motions of the turning hydraulic motor 2A in the direction in which the bucket 6 moves toward the wall surface and in the direction in which the bucket 6 moves away from the wall surface of one end portion of the trench, only the motion of the turning hydraulic motor 2A in the direction in which the bucket 6 moves toward the wall surface. Thereby, the shovel 100 allows the upper turning body 3 to turn in the direction in which the bucket 6 moves away from the wall surface of the trench, and the degree of flexibility of the operation of the operator can be improved.

When the processing of step S306 is completed, the controller 30 proceeds to step S308.

The processing of steps S308, S310 are the same as steps S106, S108 of FIG. 12, and explanation thereabout is omitted.

As described above, in this example, in the case where some of the hydraulic actuators of the plurality of hydraulic actuators are synchronously moved, the controller 30 can prohibit the operation of other hydraulic actuators different from the some of the hydraulic actuators according to the work contents of the shovel 100.

[Modifications and Changes]

Although the embodiment has been described in detail above, the present disclosure is not limited to the particular embodiment, and various modifications and changes can be made within the subject matter of the claims.

For example, in the above-described embodiment, in the case where the shovel 100 is remotely operated, the motion of some of the hydraulic actuators may be prohibited by the control apparatus 210 of the management apparatus 200, instead of the controller 30 of the shovel 100. In this case, the control apparatus 210 (an example of a control part) of the management apparatus 200 (an example of a remote operation support part) may be disabled even if the control apparatus 210 receives an operation input related to some of the hydraulic actuators of which the motions are prohibited from the remote operation apparatus 231 (an example of an operation part).

Furthermore, for example, in the above-described embodiment and the like, the operation of other actuators may be prohibited during the motion of some of the actuators regardless of whether some of the actuators are synchronously moved.

For example, the shovel 100 may be configured to prohibit the operation of a particular actuator during the motion of some of the actuators according to an input from the user. Specifically, a setting screen may be displayed on the display apparatus D1 to show the setting state of permitting or prohibiting the motions of the plurality of actuators. The controller 30 may permit or prohibit the operation of each of the plurality of actuators according to the setting that is input from the operator or the like with the input apparatus 72 (for example, as described above, a touch panel or the like) on the setting screen.

For example, in a situation where the traveling motion of the shovel 100 is unnecessary, such as loading work of earth onto a dump truck, if the shovel 100 travels due to an erroneous operation of the traveling hydraulic motors 1A, 1B by carelessness or the like, there is a possibility that a problem will occur in terms of the safety and work efficiency.

For this problem, the setting for prohibiting the motion of the traveling hydraulic motor 1M (traveling hydraulic motors 1ML, 1MR) is made in advance, so that the occurrence of such a situation can be alleviated.

In addition, for example, if the bucket 6 is moved by an erroneous operation of the bucket cylinder 9 due to carelessness or the like in a situation where the motion of the bucket 6 is unnecessary, a problem may occur in terms of the safety and work efficiency due to contact between a cable for suspension work and the back surface of the bucket 6.

For this problem, the occurrence of such a situation can be alleviated by making a setting to prohibit the motion of the bucket cylinder 9 in advance.

In addition, for example, it may be necessary for a worker to move to the range where the attachment of the shovel 100 reaches (including the range of the motion of the upper turning body 3) or to a position below the attachment.

In such a situation, the setting for prohibiting the motion of the boom cylinder 7 is made to the extent that it does not interfere with the work, so that the reduction in the safety of the work site including the shovel 100 can be alleviated.

Furthermore, for example, in the above-described embodiment and the like, the shovel 100 is configured to hydraulically drive all of the plurality of driven elements such as the lower traveling body 1, the upper turning body 3, the boom 4, the arm 5, and the bucket 6. However, two or more, or all, of them may be configured to be electrically driven. For example, the upper turning body 3 may be electrically driven by a turning motor (an example of a turning motor) as described above instead of being hydraulically driven by the turning hydraulic motor 2A. That is, the configuration and the like disclosed in the above-described embodiment may be applied to a hybrid shovel, an electric shovel, and the like.

According to the above-described embodiment, a reduction in the work efficiency of the shovel can be alleviated when the work is performed by synchronously moving a plurality of actuators.

What is claimed is:

1. A shovel comprising:

a plurality of driven elements;

a plurality of actuators configured to drive the plurality of driven elements; and a hardware processor configured to, in response to detecting that two or more actuators of the plurality of actuators are synchronously moved, prohibit a motion of another actuator of the plurality of actuators that is different from the two or more actuators of the plurality of actuators, wherein the hardware processor is configured to determine whether there is a possibility that a motion in which the two or more actuators are synchronously moved proceeds to another motion, and to cancel the prohibition of the motion of the another actuator in response to determining that there is the possibility.

2. The shovel according to claim 1, wherein the processor is configured to, in response to detecting that the two or more actuators of the plurality of actuators are synchronously moved, prohibit the motion of the another actuator of the plurality of actuators that is different from the two or more actuators of the plurality of actuators, according to a work content of the shovel.

3. The shovel according to claim 2, wherein the plurality of driven elements include an upper turning body turnably mounted on a lower traveling body, a boom attached to the upper turning body, an arm attached to an end of the boom, and a bucket attached to an end of the arm, wherein the plurality of actuators include a turning motor configured to drive the upper turning body, a boom cylinder configured to drive the boom, an arm cylinder configured to drive the arm, and a bucket cylinder configured to drive the bucket, and wherein the processor is configured to prohibit the turning motor from operating, in response to detecting that two or more, or all, of the boom cylinder, the arm cylinder, and the bucket cylinder of the plurality of actuators are synchronously moved to perform finishing work of a ground.

4. The shovel according to claim 2, wherein the plurality of driven elements include an upper turning body turnably mounted on a lower traveling body, a boom attached to the upper turning body, an arm attached to an end of the boom, and a bucket attached to an end of the arm, wherein the plurality of actuators include a turning motor configured to drive the upper turning body, a boom cylinder configured to drive the boom, an arm cylinder configured to drive the arm, and a bucket cylinder configured to drive the bucket, and wherein the processor is configured to prohibit the turning motor from operating, in response to detecting that two or more, or all, of the boom cylinder, the arm cylinder, and the bucket cylinder of the plurality of actuators are synchronously moved to perform construction work of a slope.

5. The shovel according to claim 2, wherein the plurality of driven elements include an upper turning body turnably mounted on a lower traveling body, a boom attached to the upper turning body, an arm attached to an end of the boom, and a bucket attached to an end of the arm, wherein the plurality of actuators include a turning motor configured to drive the upper turning body, a boom cylinder configured to drive the boom, an arm cylinder configured to drive the arm, and a bucket cylinder configured to drive the bucket, and wherein the processor is configured to prohibit the turning motor from operating, in response to detecting that two or more, or all, of the boom cylinder, the arm cylinder, and the bucket cylinder of the plurality of actuators are synchronously moved to perform construction work of a trench.

6. The shovel according to claim 5, wherein the processor is configured to, in response to detecting that the two or more, or all, of the boom cylinder, the arm cylinder, and the bucket cylinder of the plurality of actuators are synchronously moved to perform the construction work at one widthwise end of the trench, prohibit the turning motor from operating in a direction to move the bucket toward a wall surface of the one end portion of the trench.

7. The shovel according to claim 1, wherein the plurality of driven elements include an upper turning body turnably mounted on a lower traveling body, a boom attached to the upper turning body, an arm attached to an end of the boom, and a bucket attached to an end of the arm, wherein the plurality of actuators include a turning motor configured to drive the upper turning body, a boom cylinder configured to drive the boom, an arm cylinder configured to drive the arm, and a bucket cylinder configured to drive the bucket, and wherein the processor is configured to, in response to detecting that the two or more of the plurality of actuators are automatically synchronously moved according to an operation related to one actuator of the two or more of the plurality of actuators, prohibit the motion of the another actuator.

8. The shovel according to claim 7, wherein the processor is configured to prohibit the turning motor from operating, in response to detecting that two or more, or all, of the boom cylinder, the arm cylinder, and the bucket cylinder are automatically synchronously moved according to an operation related to the arm cylinder.

9. The shovel according to claim 7, wherein in a case where the processor is configured to prohibit a motion of at least one of the arm cylinder and the bucket cylinder, in response to detecting that the turning motor and the boom cylinder of the plurality of actuators are automatically synchronously moved according to an operation related to the turning motor.

10. The shovel according to claim 7, wherein the processor is configured to prohibit a motion of at least one of the boom cylinder and the turning motor, in response to detecting that the arm cylinder and the bucket cylinder of the plurality of actuators are automatically synchronously moved according to an operation related to the bucket cylinder.

11. The shovel according to claim 1, further comprising:

a hydraulic pump; and a plurality of spool valves associated with the plurality of actuators, wherein each of the plurality of spool valves is configured to, in response to an operation related to an associated actuator among the plurality of actuators, receive a signal corresponding to a content of the operation and move a spool in one of two opposite directions to supply hydraulic oil discharged from the hydraulic pump to one of two ports of the associated actuator and discharge the hydraulic oil from the other of the two ports of the the associated actuator, wherein the processor is configured to, in response to detecting that the two or more of the plurality of actuators are synchronously moved and that an operation related to the another actuator is performed to move a spool valve associated with the another actuator among the plurality of spool valves in one of the two opposite directions, input, to the associates spool valve, a signal for moving the associated spool valve in the other of the two opposite directions.

12. The shovel according to claim 1, wherein the processor is configured to send a notification to an operator, when the processor prohibits the motion of the another actuator.

13. The shovel according to claim 1, wherein the another actuator whose motion is to be prohibited is determined with respect to each of motion contents of the shovel.

14. The shovel according to claim 1, wherein a combination of the two or more actuators to be synchronously moved and the another actuator whose motion is to be prohibited is determined with respect to each of different motion contents of the shovel.

15. A remote operation support apparatus comprising:

a remote controller configured to remotely operate a plurality of actuators of a shovel that includes a plurality of driven elements and the plurality of actuators configured to drive the plurality of driven elements;

a transmitter configured to transmit an operation command related to the plurality of actuators to the shovel in response to an operation of the remote controller; and a hardware processor configured to prohibit a motion of an actuator of the plurality of actuators that is different from two or more actuators of the plurality of actuators, wherein the hardware processor is configured to determine whether there is a possibility that a motion in which the two or more actuators are synchronously moved proceeds to another motion, and to cancel the prohibition of the motion of the actuator in response to determining that there is the possibility.

* * * * *